US008100299B2

(12) United States Patent
Phelps et al.

(10) Patent No.: US 8,100,299 B2
(45) Date of Patent: Jan. 24, 2012

(54) COUNTER-MOUNTED VISCOUS LIQUID DISPENSER AND MOUNTING SYSTEM

(75) Inventors: Stephen Lawrence Phelps, Lilburn, GA (US); Andrew Joseph Beltz, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1060 days.

(21) Appl. No.: 12/006,130

(22) Filed: Dec. 31, 2007

(65) Prior Publication Data

US 2009/0166381 A1 Jul. 2, 2009

(51) Int. Cl.
*B67D 5/06* (2006.01)

(52) U.S. Cl. ..... 222/180; 222/325

(58) Field of Classification Search ..... 222/180, 222/173, 181.1, 162, 186, 185.1, 190, 324, 222/325

See application file for complete search history.

(56) References Cited

U.S. PATENT DOCUMENTS

| | | | | |
|---|---|---|---|---|
| 5,226,566 | A | 7/1993 | Brandenburg | |
| 5,240,147 | A | 8/1993 | Frazier | |
| 5,287,996 | A | 2/1994 | Uhlig | |
| 5,476,197 | A | 12/1995 | Lawrence | |
| 5,515,882 | A | 5/1996 | Hennis | |
| 5,988,440 | A | 11/1999 | Saunders | |
| 6,119,901 | A | 9/2000 | Hanna | |
| 6,142,342 | A | 11/2000 | Lewis | |
| 6,385,798 | B1 | 5/2002 | Burns | |
| 6,571,407 | B1 | 6/2003 | Skarie | |
| 6,929,150 | B2 | 8/2005 | Muderlak | |
| 7,753,087 | B2 * | 7/2010 | Rhodenbaugh et al. | 141/18 |
| 7,815,074 | B2 * | 10/2010 | Ciavarella et al. | 222/153.09 |
| 2005/0155988 | A1 | 7/2005 | Meehan | |

FOREIGN PATENT DOCUMENTS

| | | | |
|---|---|---|---|
| JP | 60-101447 | U | 7/1985 |
| JP | 2005-324801 | A | 11/2005 |
| WO | WO 2007/095384 | | 8/2007 |

* cited by examiner

*Primary Examiner* — Davis Hwu

(74) *Attorney, Agent, or Firm* — Nancy M. Klembus; Ralph H. Dean

(57) ABSTRACT

The present invention provides an in-counter viscous liquid dispensing system. The features of the viscous liquid dispensing system include a quick mounting reservoir assembly that allows an installer to install the reservoir assembly in any orientation of the reservoir assembly to the counter mounted parts of the system. Other features include a mounting system which allows an installer to install the in-counter dispensing system with out the need to work both above and below the counter top.

28 Claims, 18 Drawing Sheets

COUNTER-MOUNTED VISCOUS LIQUID DISPENSER AND MOUNTING SYSTEM

FIELD OF THE INVENTION

The present invention relates generally to a counter-mounted viscous liquid dispenser for dispensing viscous liquids, such as hand soap and hand lotion, and a mounting system for the dispensing system.

BACKGROUND OF THE INVENTION

A wide variety of counter-mounted viscous liquid dispensers, which are also referred to as "in-counter" viscous liquid dispensers, are known in the art. One problem in the art of the in-counter viscous fluid dispensers is refilling an empty reservoir. Some reservoirs are refilled from the top of the counter by removing the dispensing head, attaching an adapter and attaching a refill container to the adapter. Gravity transfers the viscous liquid from the refill container to the dispenser reservoir. These types of refilling means often leak, causing loss of the viscous liquid and often require time and resources to clean-up any leaked or spilled viscous liquid.

In other under-counter dispensing systems that are commercially available, refills are completed by removing an empty reservoir and replacing the empty reservoir with a replacement reservoir which is filled with a viscous liquid. The problem with the systems which are currently commercially available is that the replacement reservoirs need to be properly aligned with a connecting means in order to install the refill reservoirs. This is because the element which actuates the pump of these systems is generally off center, which requires that the refill be in a particular orientation for the system to dispense the viscous liquid. Some solutions to this problem have included the use of additional actuator openings for the actuator rod to contact an engaging element, which actuates the pump in the refill reservoir, so that the refill can be installed in several different positions. However, these systems still have limited orientations that allow the refill reservoir to attach to the dispensing system. Even with more than one orientation, it can still be difficult to properly align the refills with the connecting means while working under a counter.

Typically, counter-mounted soap dispensers have a dispensing head which is part of the mounting assembly. Generally, the dispensing head has a rigid tube extending from the counter contacting side of the dispensing head and this rigid tube extends through the counter to the underside of the counter. To mount the dispenser, the rigid tube of the dispenser is inserted into a hole present in the counter. The rigid tube is long enough so that the tube extends from about the top surface of the counter, through the hole in the counter with the end of the tube opposite the dispensing head extending downward past the bottom surface of the counter. The hole in the counter is of a size so that the rigid tube can extend through the counter but the dispensing head will not. That is, the dispensing head of the dispenser is wider than the hole in the counter. Generally, threads are present on an outer diameter of the rigid tube. A locking device, such as a locking nut, is threaded onto the threads of the tube and tightened to contact the bottom surface of the counter. It is the tightening of the locking device that secures that dispenser to the counter. An example of the mounting mechanism is shown in U.S. Pat. No. 6,142,342 to Lewis.

While this type of mounting mechanism is effective in mounting a counter-mounted soap dispenser onto a counter, it is often difficult to install counter-mounted soap dispensers onto counters using this type of mechanism, especially after the counter is installed in the place of use. This is because to install a viscous liquid dispenser having the mounting system described above after a counter is installed, the installer needs to work both above and below the counter to tighten the locking device and position the dispenser in the proper orientation. Working space under counters in rest rooms is often limited, making it difficult, time consuming and/or costly to install these counter-mounted soap dispensers. As a result, to replace one of these dispensers in a public rest room it may be necessary to close the rest room for a period of time, have two people work in tandem, and/or remove the installed counter top for proper access to the mounting system.

Dispensers over time become inoperative for one reason or another. When in public rest rooms, these dispensers are also abused and/or vandalized by some users. When this occurs, the dispensers will need to be replaced. Replacing a dispenser which is mounted using a conventional mounting system is also difficult and time consuming. This is because the attachment process described above needs to be reversed to remove the inoperative dispenser. Alternatively, the inoperative dispenser could be cut away from the counter, which would require the installer to carry additional tools. In addition, cutting or destroying could result in damage to the counter top.

There is a need in the art for an easy to install and easy to replace counter-mounted viscous liquid dispenser. In addition, there is a need in the art for an easy and convenient way to refill in-counter dispensers.

SUMMARY OF THE INVENTION

Generally stated, the present invention provides an in-counter viscous liquid dispensing system having advantages over currently available in-counter viscous liquid dispensing systems. The present invention provides solutions to needs in the viscous liquid dispensing art, including providing an easier way to install refill reservoirs. The present invention also provides a mounting system which allows an installer to install the counter-mounted viscous liquid dispenser without the need to attach the dispenser by working under the counter.

In one embodiment of the present invention, provided is a reservoir assembly for use with an in-counter mounted viscous liquid dispenser. This reservoir assembly has a container housing for holding a quantity of a viscous liquid, where the container housing has a main container and a top portion secured to the main container. The top portion comprising a central longitudinal axis, a mounting element which may be a movable member having a detent element or a stationary member having a recessed portion adapted to accept a detent element. The container housing also has a pump device located within the container housing, the pump device operative to pump the viscous liquid through a fluid outlet defined in the top portion of the container housing. The reservoir also has an engaging element operative to cause actuation of the pump device, the engaging element located along the central longitudinal axis of the top portion.

In another embodiment of the present invention, provided is a counter mounted viscous liquid dispensing apparatus having a reservoir assembly and a fixture assembly. The reservoir assembly has a container housing for holding a quantity of a viscous liquid. The container housing has a top portion, where the top portion has a central longitudinal axis, a mounting element selected from a movable member having at least one protrusion on a surface of the movable member or a stationary member having a recessed portion. Also included within the container housing is a pump device located within the container housing. This pump device is operative to pump the viscous liquid through a fluid outlet defined in the top portion of the container housing. To activate the pump an engaging element which causes actuation of the pump device is also present. The engaging element is located along the central longitudinal axis of the top portion. The dispensing apparatus further has a fixture assembly mounted to a counter. The fixture assembly has a dispenser head mounted to the counter; and a connecting member directly or indirectly mounted to the dispenser head. This connecting member has a mounting element wherein the mounting element of the connecting member has a complementary mounting element to the mounting element of the top portion of the container housing. The connecting member has a stationary member having a recessed portion when the top portion mounting element is a movable member having at least one protrusion. Alternatively the connecting member has a movable member having at least one protrusion when the top portion mounting element has a stationary member having at least one recess portion.

In another embodiment of the present invention, provided is a mounting system for mounting a viscous liquid dispenser in a counter. The mounting system has a an elongated structure comprising a proximate end, a distal end, a hollow shaft extending from the proximate end to the distal end, a flange located at or adjacent the proximate end, an anchoring mechanism located along the shaft intermediate the flange and the distal end; and an anchoring mechanism engagement member located at or near the proximate end. The anchoring mechanism is adapted to directly or indirectly contact a lower surface of the counter and the flange is adapted to directly or indirectly rest on an upper surface of the counter and the anchoring mechanism engagement member is adapted to deploy the anchoring mechanism to secure the mounting system to the counter.

By providing the dispensing apparatus, container and mounting system of the present invention, drawbacks of the conventional viscous liquid dispensing systems are minimized.

DEFINITIONS

Figure 1:
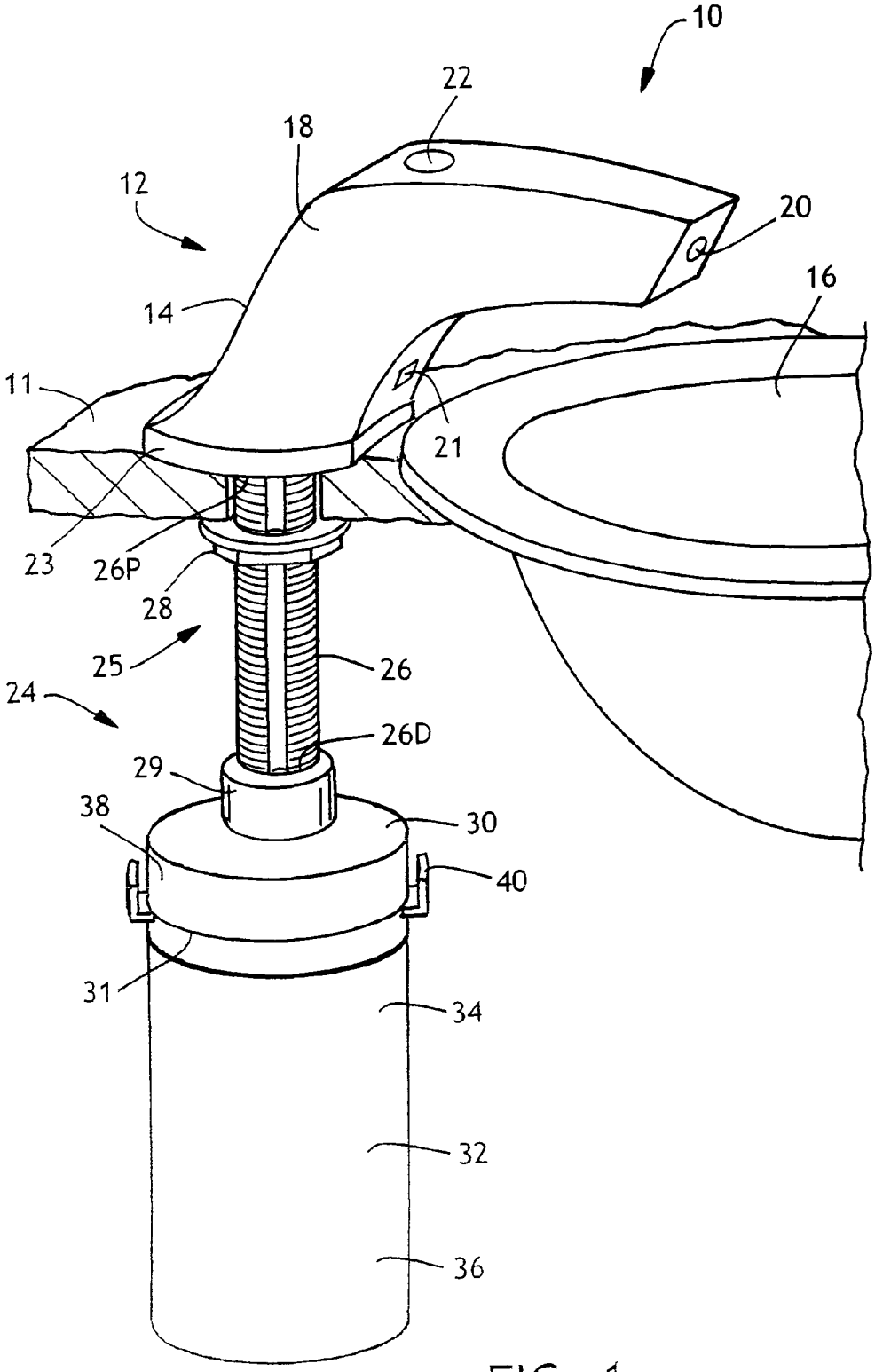
FIG. 1 illustrates a counter-mounted viscous liquid dispenser of an embodiment of the present invention installed in a typical washroom counter.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

It should be understood that the terms "horizontal", "vertical", "up", "down" are all intended to be relative terms and are for reference in the drawings only.

DETAILED DESCRIPTION OF THE INVENTION

The present invention provides an easy to maintain in-counter viscous liquid dispenser. Also provided is an easy to install and easy to replace viscous liquid dispensing system. The viscous liquid dispensing system of the present invention can be installed in new installations of counters or may be retrofitted to existing counters.

In the following detailed description of the present invention, reference is made to the accompanying drawings which form a part hereof, and which show by way of illustration, specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

FIG. 1 illustrates a dispenser apparatus 10 of the present invention, mounted in a counter 11 in a typical washroom facility. As shown, the dispenser apparatus includes a dispenser fixture 12 having an above-counter portion 14 located adjacent to a sink bowl 16. As shown, above-counter portion 14 includes a dispensing head 18 having a delivery spout 20 extending from the dispensing head 18. Delivery spout 20 is positioned and configured in a conventional manner to supply soap or other viscous liquid to the hand of a user. As shown, the delivery spout 20 is positioned over the sink bowl 16, so that in an event that the viscous liquid is unintentionally dispensed from the dispensing apparatus, the viscous liquid will make its way into the sink bowl 16, rather than the counter 11. To dispense the viscous fluid from the dispenser apparatus, a user presses an actuation button 22, which in turn activates a pump and a quantity of the viscous liquid delivered to the user's hand. Alternatively, the dispenser apparatus may have an electronic sensor 21, positioned such that the electronic sensor can detect the hands of a user under the delivery spout. When the electronic sensor 21 detects the user hand under the delivery spout, an electronic means is activated and a quantity of the viscous liquid delivered to the user's hand.

The dispenser fixture 12 includes an under-counter portion 24 having a mounting system 25 securing the dispenser fixture 12 to the counter. The mounting system 25 has an elongated tube 26, which is a generally elongated hollow tube, extending through a hole defined in counter 11. By "hollow", it is intended that a tube has a passage or channel (not shown in FIG. 1) that extends through the elongated tube 26 from proximate end 26P of the elongated tube 26, which is located above the counter 11, to the distal end 26D of the elongated tube 26 located below the counter 11. The elongated tube 26 has a flange 23 on the end of the elongated tube that is positioned above the counter 11. The flange 23 is of a size which is larger than the hole in the counter 11 and the flange 23 serves to keep the elongated tube 26 from falling through the counter 11. As is shown in FIG. 1, the mounting system 25 also has an anchoring mechanism 28 associated with the portion of the elongated tube 26 which extends below the counter 11. The mounting system shown in FIG. 1 is one type of mounting system which may be used in the present invention. It is noted that other types of mounting systems may also be used. The mounting system 25 as shown in FIG. 1 has an elongated tube 26 which is threaded and the anchoring mechanism 28 is a nut threaded onto the threads of the elongated tube 26. Other mounting systems may be used in place of the mounting system 25 shown in FIG. 1, including the mounting system described in an alternative embodiment of the present invention. The mounting system of the alternative embodiment of the present invention will be discussed in more detail below.

The under-counter portion 24 also has a connecting member 30, located at the distal end 26D of the elongated tube 26. The connecting member 30 is removably connected to the distal end 26D of the elongated tube 26 at a top end 29 of the connecting member 30. The connecting member 30 supports a reservoir assembly 32 which contains the viscous liquid to be dispensed from the dispenser apparatus 10. The reservoir assembly 32 is removably connected to the connecting member 30 to the lower end 31 of the connecting member, also referred to as the reservoir connecting surface, such that the reservoir assembly 32 can be removed and replaced when the viscous liquid has been expended from the reservoir assembly 32.

Figure 2:
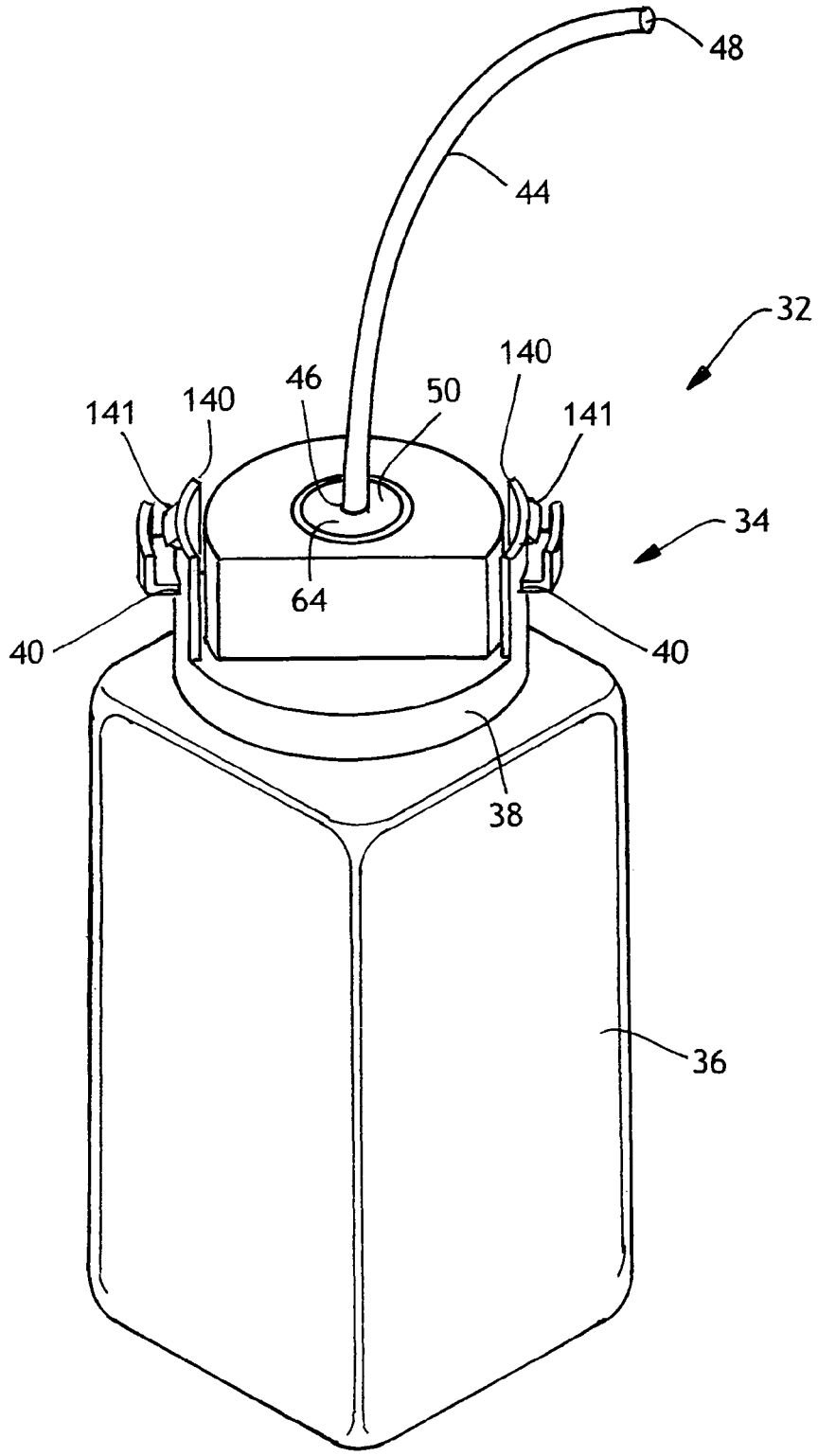
FIG. 2 illustrates a perspective view of viscous liquid reservoir of an embodiment of the present invention.

Referring to FIG. 2, reservoir assembly 32 includes a container housing 34 having a main container 36 and a top portion 38. The main container 36 serves to hold and contain the viscous liquid that is to be dispensed from the dispensing apparatus. The top portion 38 is secured to the main container 36 in a manner such that the top portion 38 is removably secured to the main container or such that the top portion 38 is permanently secured to the main container 36. For example, the top portion 38 may be sealed to main container 36 using ultrasonic welding, adhesive or other suitable means of effecting a permanent attachment of the top portion 38 to the main container 36. If it is desirable that the top portion 38 is removable from the main container, the top portion 38 could be mated to the main container using known methods, such as a threaded top portion 38 and a threaded main container 36. Other similar methods could be used to removably secure the top portion 38 to the main container 36.

As shown in FIG. 2, top portion 38 of the container housing also has mounting elements 40. The mounting elements serve to connect the reservoir assembly 32 to the remainder of the dispensing apparatus 10. In the present invention, the mounting elements 40 are designed to engage in any rotational degree of the top portion 38 in relation to the plane created by the connecting member 30. That is, the mounting elements 40 present on the top portion 38 and the connecting member 30 will engage one another in any rotational orientation in the plane of the mounting member 30. As a result, there does not need to be a specific orientation of the reservoir assembly 32 to the connecting member 30 in order for the reservoir assembly to connect to the connecting member 30.

Figure 3:
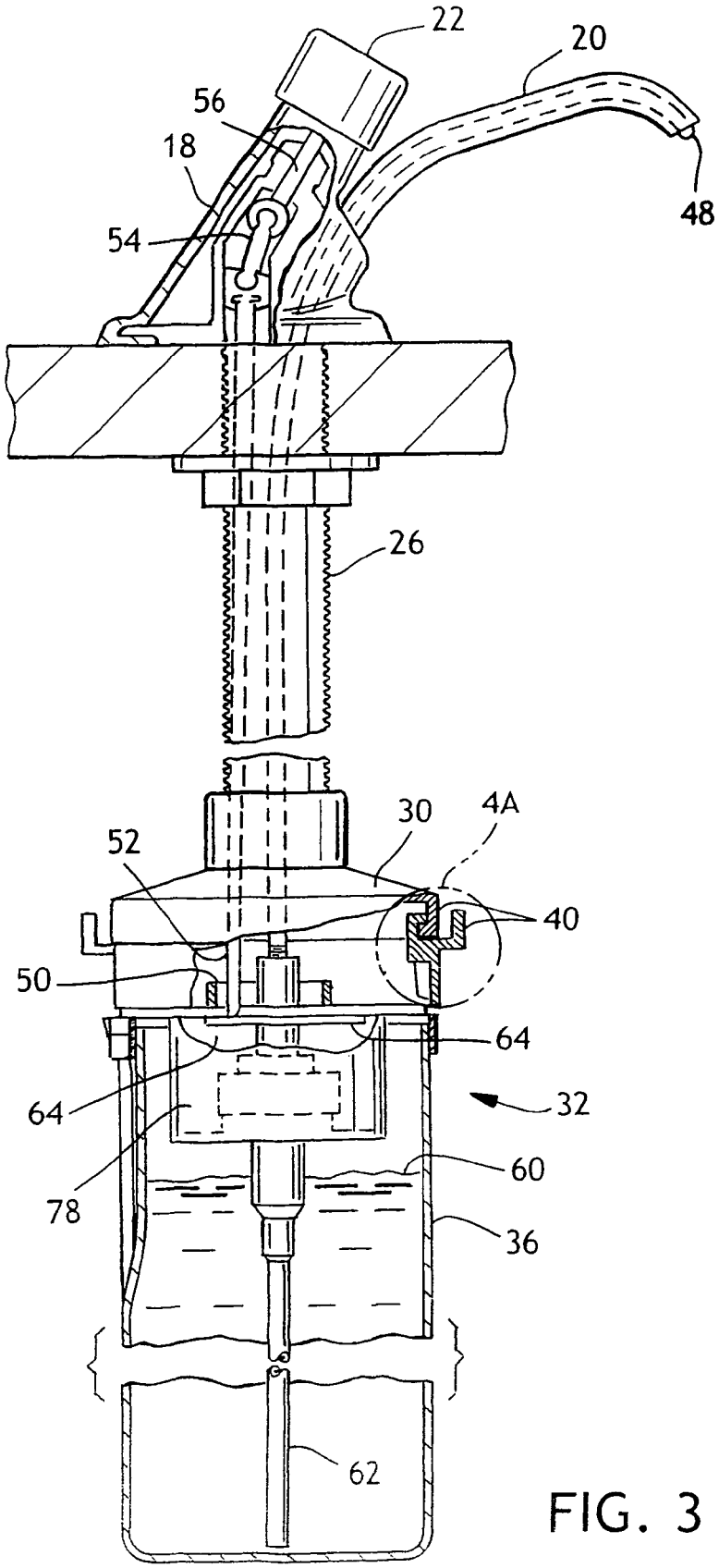
FIG. 3 shows an elevational view, partially in section, of an embodiment of a counter-mounted viscous liquid dispenser of the present invention.
Figure 4A:
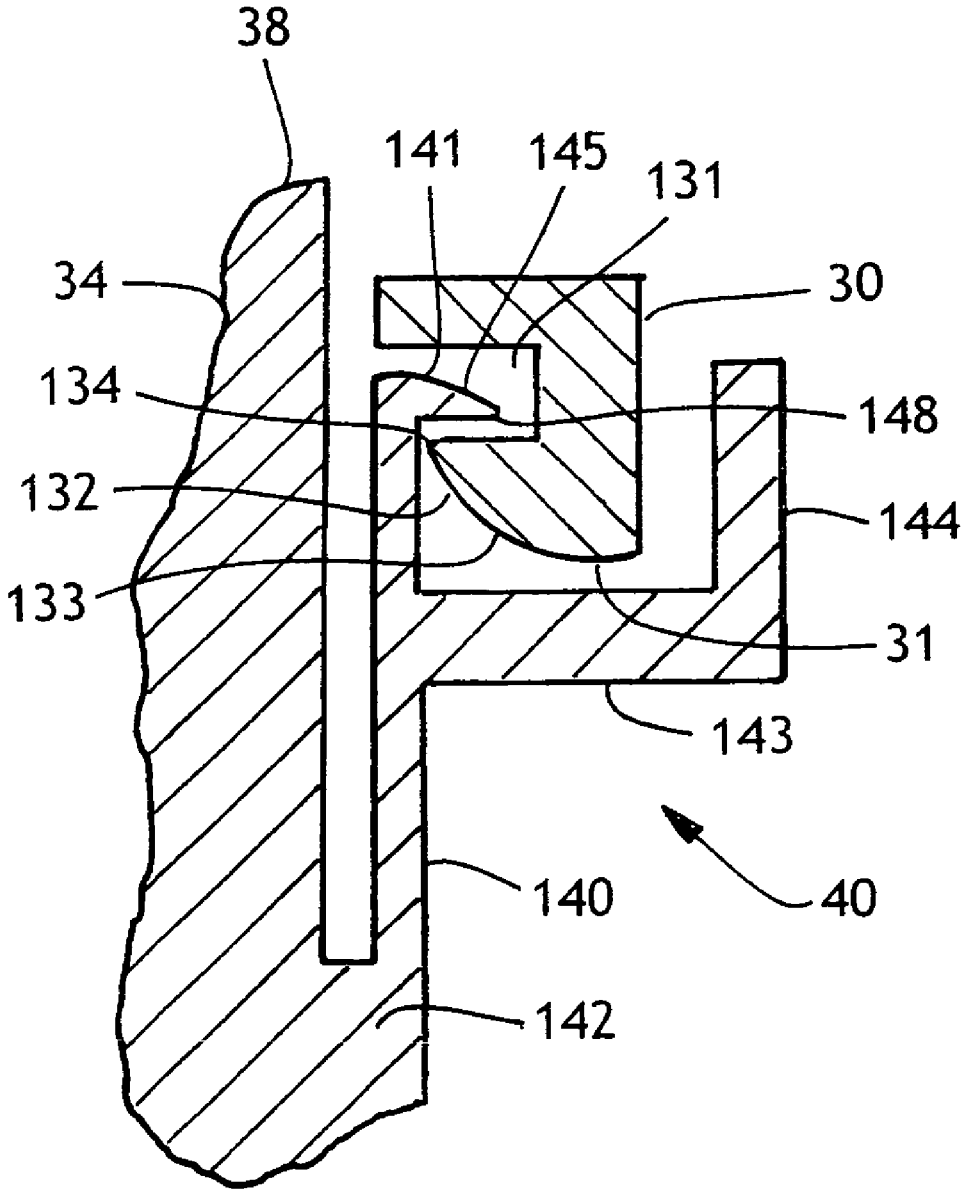
FIGS. 4A, 4B, 4C each show a cross-sectional view of an embodiment of the mounting element of the present invention.

In the present invention, the mounting elements 40 of the top portion 38 are adapted to connect to a complementary mounting element present on the connecting member 30. A mounting element useable in the present invention to connect the reservoir 32 to the remainder of the dispensing apparatus 10 include mounting elements which have a movable member having a detent element or include mounting elements which are a stationary member having a recessed portion adapted to accept a detent element. Examples of movable members with a detent element include quick connect fittings having ball bearings which move back and forth when a collar is moved away from the ball bearings and lock in place when the collar is repositioned around the ball bearings. Another movable member having a detent element is shown in FIGS. 3 and 4A. FIG. 4A shows an enlarged view of the movable member with a detent element.

As is shown in FIG. 4A, the movable member 140 has a detent element 141. Member 140 is movable about a pivot point 142 and the detent element 141 is opposite the pivot point 142 along the movable member 140. The movable member 140 may have an arm 143 attached to the movable member 140, between the pivot point 142 and the detent element 141. The arm 143 may have an upright portion 144. The upright portion 144 allows a user apply a force to the movable member 140 towards the detent element 141 which will cause the detent element 141 to disengage and release the reservoir 32 or the top portion 38 of the reservoir from the connecting member 30.

The connecting member 30, in which the detent element 141 contacts and engages to hold the reservoir assembly 32 in place during use, has a recess 131 that is adapted to accept the detent element 141, as is shown in FIG. 4A. The recess 131 is created by a lip 132 that projects from a lower end 31 of the connecting member 30. The size and shape of the recess should be such that the recess readily accepts the detent element 141, but not so large that the detent element is loose in the recess 131.

Figure 4B:
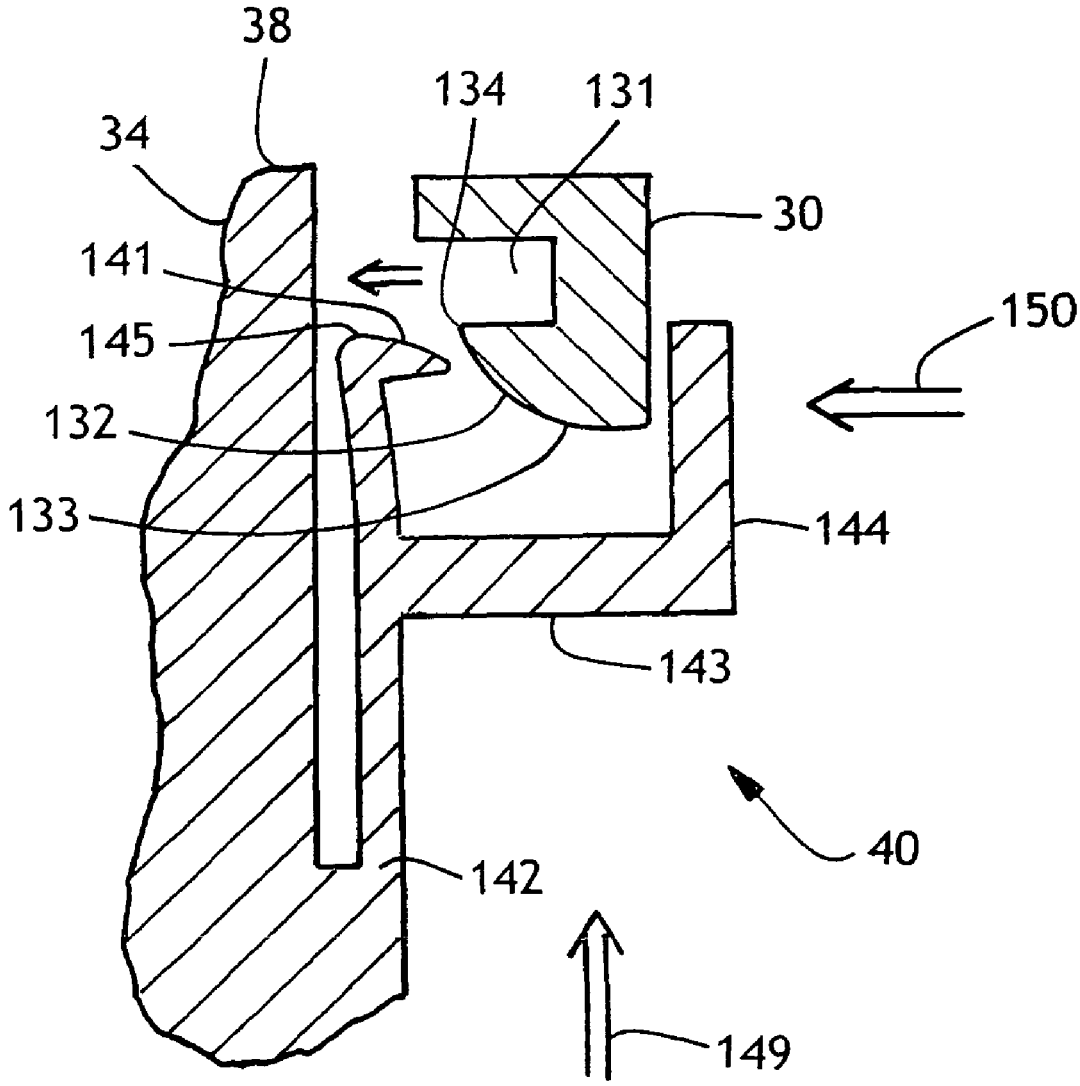

The lip 132 creating the recess may have a slanted or curved lower surface 133. In addition, the detent element 141 may have an upper surface 145 which is slanted or curved. By having these surfaces curve or slanted, as is shown in FIG. 4A, it is easier for the reservoir 34 to be attached to the connecting member 30. This is because as the detent element 141 is forced against the lower lip 133 of the connecting member 30, by moving the container housing 34 in an upward direction 149, shown in FIG. 4B, the detent element 141 is gradually pushed towards the outer edge 134 of the lower lip 133. This will cause the movable member 140 to be moved in a direction 150 that allows the detent element 141 to be positioned to engage the recess 141. As the end 148 of the detent element 141 goes above the edge 134 of the lip 132, the force exerted on the moveable member 140 is released and movable member returns to it rest position, shown in FIG. 4A, thereby connecting the reservoir assembly 32 into the connecting member 30.

Figure 4C:
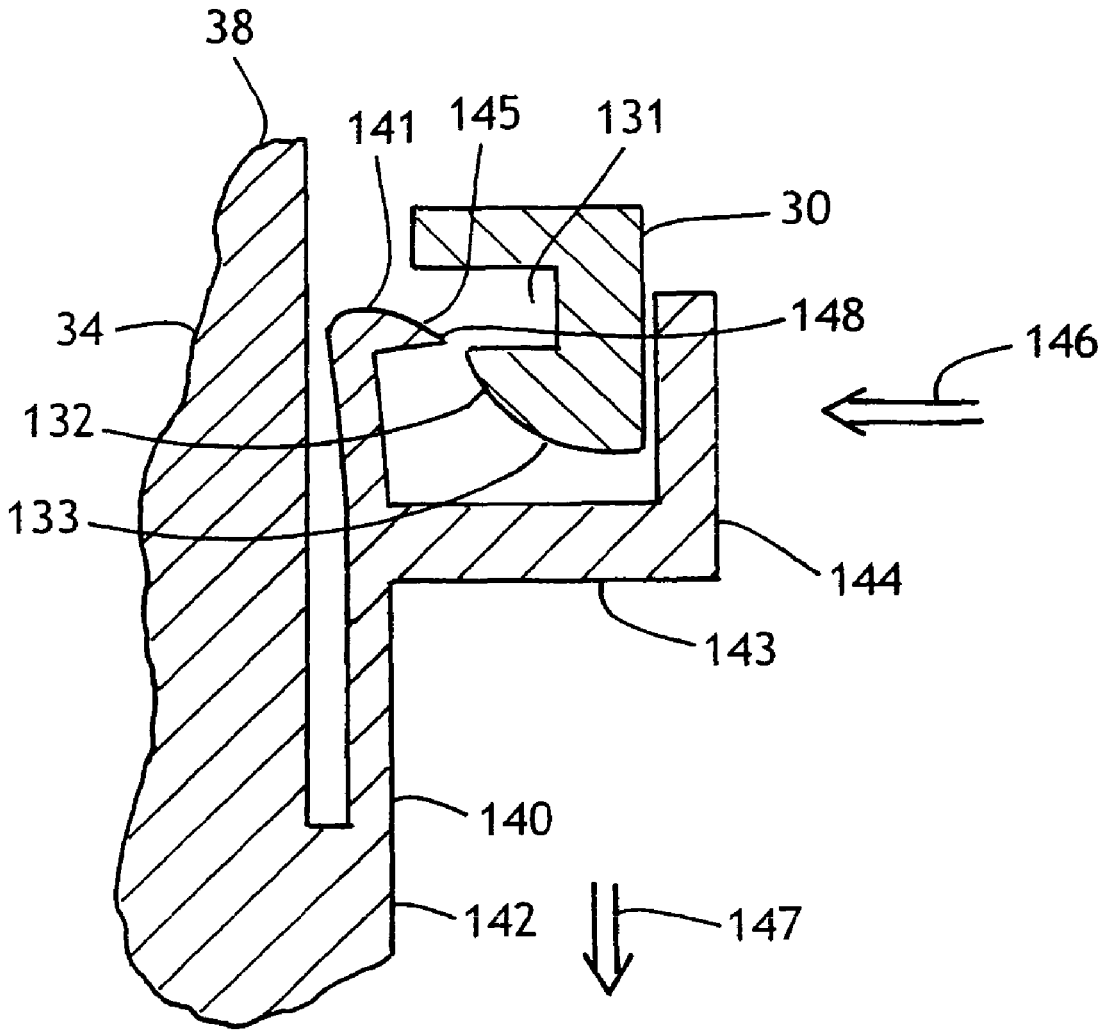

To remove the reservoir 32 from the connecting member, a force 146 is applied to the upright portion 144 of the arm, as is shown in FIG. 4C. This will cause the movable member 140 to move thereby causing the detent element 141 to move out of the recess 131. Once the detent element 141 is out of the recess 131, the reservoir 32 can be removed from the connecting member 30, by pulling downward in a direction 147 shown in FIG. 4C.

Figure 5:
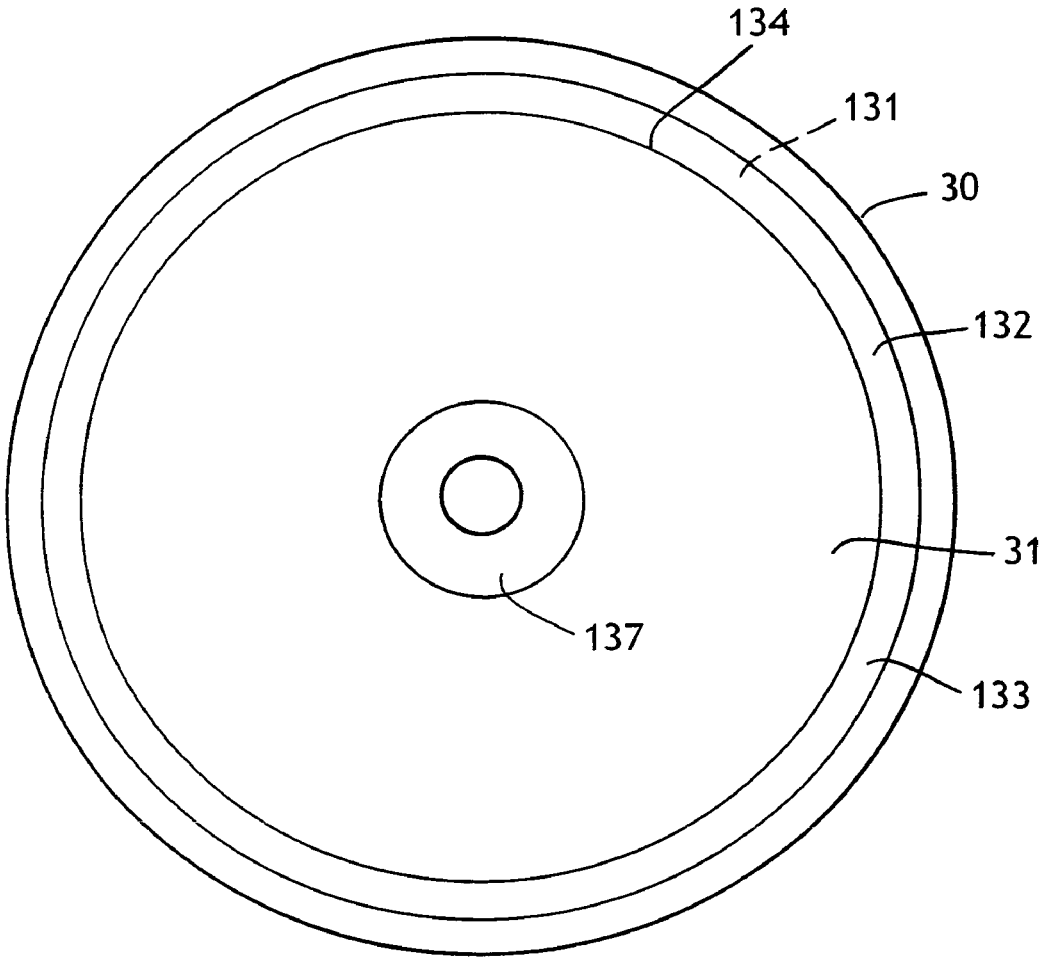
FIG. 5 shows a bottom view of the connecting member of an embodiment of the present invention.
Figure 6:
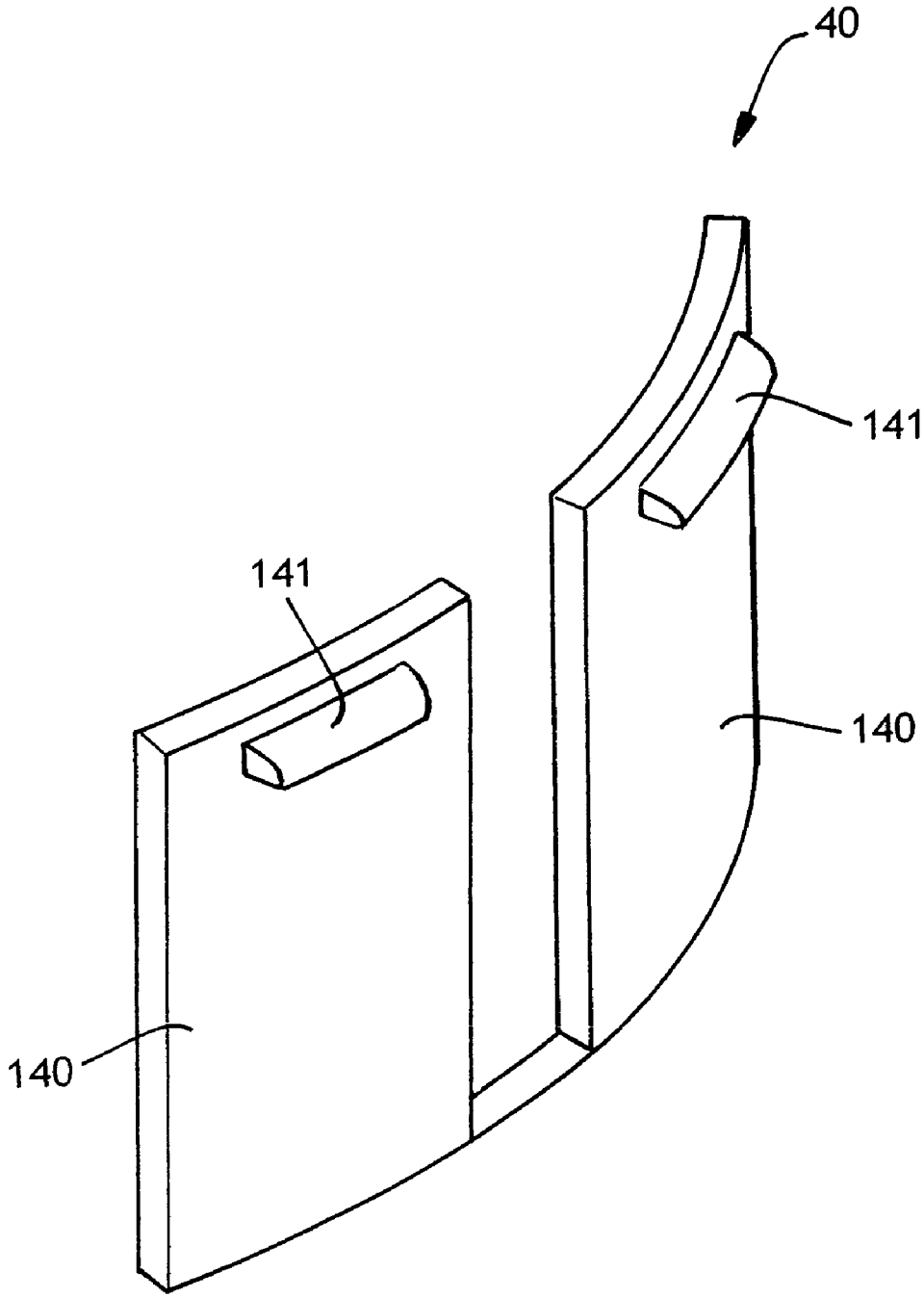
FIG. 6 shows a perspective view of an embodiment of movable members with detent elements useable in the present invention.

Connecting member 30 can be any shape, so long as the lower surface 31 or the reservoir connecting surface 31 is circular and the recess 131 is circular, as is shown in FIG. 5. By having a recess 131 which is circular, the movable members 140 on the top portion 38 of the container housing 34 along with the detent elements 141 are able to engage the recess 131 from any orientation in the lower reservoir connecting surface 31 or the plane of the reservoir connecting surface 31. This will allow the detent elements 141 to properly engage the recess 131 from any position all the way around the lower surface 31 of the connecting member 30. In one embodiment of the present invention, movable members 140 and the detent elements 141 are shaped as an arc of a circle, as is shown in FIGS. 2 and 6. The radius of the detent elements 141 are approximately matched to the radius of the recess 131 in the connecting member 30. This will insure that a proper attachment is achieved between the top portion 38 of the reservoir assembly 32 and the lower surface 31 of the connecting member 30.

Generally, there will be two or more movable members 140 present on the top portion 38 of the reservoir assembly 32. Generally, there may be up to about twenty movable members 140. The movable members 140 and the associated detent elements 141 will generally only be present in even numbers such that they are diametrically opposed on opposite sides of the top portion 38. By having the movable members 140 on opposite sides of the top portion 38, sufficient attachment of the top portion 38 to the connecting member 30 will be achieved. In one particular embodiment of the present invention, there are two movable members 140 grouped together on each side of the top portion 38, as is shown in FIG. 6. By having two movable members 140 with detent elements 141 located together on each side of the top portion 38, if one of the movable members 140 or detent elements 141 becomes damaged during installation of the reservoir assembly 32, the reservoir assembly will still lock into the connecting member 30. In addition, the movable members 140 and detent elements 141 are only generally present at two locations around the circumference of the top portion 38, as is shown in FIGS. 1 and 2. It is noted that movable members and detent elements may be located at more than two locations around the top portion 38; however, it may become come more difficult to remove the reservoir assembly from the connecting members, since all of the detent elements 141 would have to be removed at the same time.

As is shown in each of FIGS. 1, 2, 3, 4A, 4B and 4C, the detent elements 141 are present on the movable members 140 on the top portion 38 of the reservoir assembly 32. However, it is possible that the recess is present in the top portion 38 of the reservoir assembly 32 and the movable members 140 and detent elements 141 are present on the lower surface 31 of the connecting member 30. Such a configuration would work equally as well as those illustrated in FIG. 1-5. However, the configuration shown in FIGS. 1-5 may be advantages, since the detent elements 141 may become worn after many installations and removals of the reservoir assembly 32. If the detent elements 141 are on the top portion 38 of the reservoir assembly 32, the detent elements 141 will be replaced with each reservoir replacement.

In the FIGS. 1, 2, 3, 4A, 4B and 4C, the detent elements 141 are positioned such that the detents face away from the central axis 1 of the reservoir assembly. However, it is possible for the detent elements 141 to face towards the central axis 1 of the reservoir assembly. In such a case, the recesses on the complementary mounting members will be exposed outside the connecting member 30 (not shown). The only difference in operation would be that the pivot point 142 of the movable member would need to be between the detent element 141 and the arm 143 attachment point. This is because the movable members 140 and detents 141 would have to be moved in the opposite direction to disengage the detent elements from the recess 131.

The connecting member 30 further has an opening 137 in the central area of the connecting member, as is shown in FIG. 5. This opening 137, when the connecting member 30 is attached to the distal end 26D of the elongated hollow tube 26, is aligned with the hollow portion or channel which extends from the distal end 26D of the elongated tube 26 to the proximate end 26P of the elongated tube. As a result, the hollow portion of the elongated tube 26 is extended to the lower side 31 of the connecting member 30. Also, the delivery spout 20 of the dispensing head 18 is also aligned with the hollow portion of the elongated tube 26.

Referring back to FIG. 2, the container housing 34 has a flexible delivery tube 44 extending from a fluid outlet 46 in top portion 38. The fluid outlet 46 is connected to an outlet of a pump device (described below) which is housed within the container housing 34. When the container housing 34 is being installed and connected to the connecting member 30, the delivery tube 44 is inserted through the opening 137 in the connecting member 30, up through the hollow portion of the elongated tube 26, into the dispensing head 18 and into the delivery spout 26, as is shown in FIG. 3. The length of the delivery tube 44 is selected such that end 48 thereof will reside just beyond the end of spout 20. For improved flow, the end 48 may be hemispherical, as is shown in FIG. 3. By having the flexible delivery tube extend into the dispensing head 18 and the spout 20 of the head, the viscous liquid will not come into contact with the inner surfaces of the delivery head 18 and spout 20 as the viscous liquid is being dispensed. This will prevent or reduce the need to clean the outlet of the dispensing head 18 on a regular basis, since the delivery tube 44 is replaced each time the reservoir assembly 32 is replaced.

The top portion 38 also defines an actuator opening 50 which is positioned about the center line of the top portion 38. In one embodiment of the present invention, the outlet 46 will be centrally located in the actuator opening 50, as is shown in FIG. 2. The actuator opening 50 is one single opening so an actuator rod 52 can come into contact with the engaging element 64, to cause the pump to dispense a dose of the viscous liquid, as can be seen in FIG. 3. When the dispensing head 18 is a manual dispensing head, as is clearly shown in FIG. 3, the dispenser fixture includes an actuator rod 52 that extends from the dispensing head 18, down through the hollow portion of the elongated tube 26, through the opening 137 of the connecting member 30 and through the actuator opening 50 when reservoir assembly 32 is installed on the connecting member 30.

The actuation button 22 can activate the pump manually, meaning the user applies a force to the actuation button 22 which causes the pump to move a quantity of the viscous liquid from a reservoir to the delivery spout 20. Alternatively, a user pressing the actuation button 22 activates an electric motor, which in turn activates a pump. In an alternative embodiment of the present invention, the sensor 21 may be used to detect a user and to activate an electric motor to cause the pump to be activated. Electronic activation of the pump will be covered in more detail below.

Generally, when the dispensing head 18 is a manual dispensing head as shown in FIG. 3, the actuation button 22 is directly or indirectly connected with the actuator rod 52. As shown in FIG. 3, actuator rod 52 is connected via a linkage element 54 to a rod segment 56. In turn, rod segment 56 is attached to actuation button 22. Actuator rod 52 will thus be moved in a vertical downward direction when a user pushes actuation button 22.

A pump device 58 is located inside of reservoir 32 to draw viscous liquid (indicated as 60) into an intake tube 62. The viscous liquid passes through the pump 58, and is pushed out through delivery tube 44. The pump is actuated by reciprocative movement of an engaging element 64 having contact portions registered with actuator openings 50. The free distal end of actuator rod 52 thus pushes against a contact portion of engaging element 64 when a user pushes actuation button 22.

The pump device 58 is advantageously constructed from widely available "stock" components in order to enhance manufacturing efficiencies. Specifically, pump device 58 is preferably a common lotion pump of the type in widespread use with bottled lotions, shampoos and the like. One such pump that may be suitable for this purpose in some applications is Model SD-200, available from Calmar, Inc. Many other models of lotion pumps are also available on the market, and may be utilized depending on variables such as shot size and the like. As will be explained below, the pump device may be modified in several ways for use in reservoir assembly 32.

Figure 7:
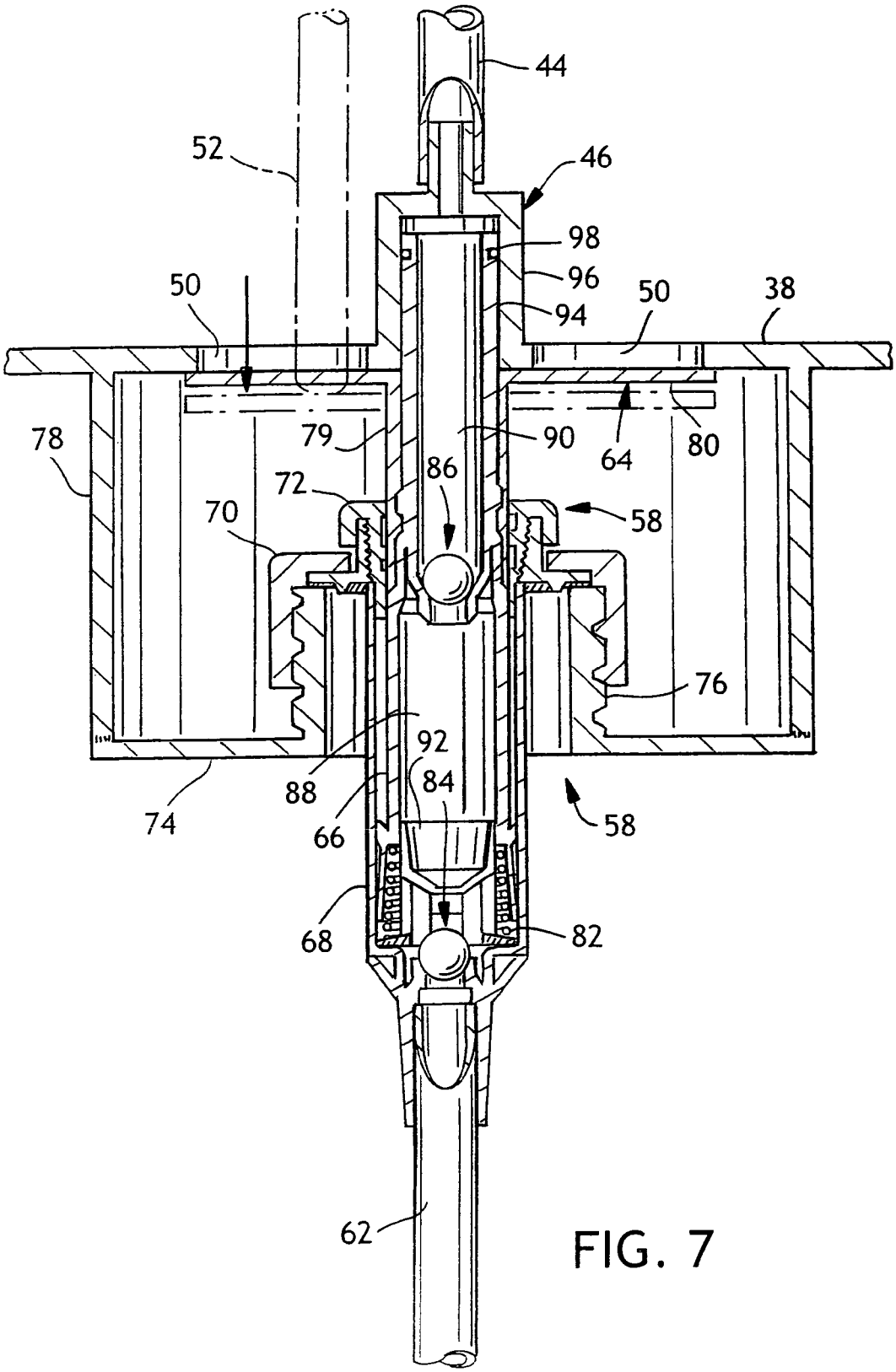
FIG. 7 shows an enlarged cross-sectional view of a typical pump device usable in the viscous liquid dispenser of the present invention.

To gain a better understanding of an exemplary pump that may be used in the present invention, attention is now directed to FIG. 7. As shown, pump device 58 includes a tubular piston 66 located inside of a pump cylinder 68. Pump device 58 further includes a cap element 70, which is maintained in an axially fixed relation with respect to pump cylinder 68 by virtue of a chaplet 72. Cap element 70 is advantageously utilized to mount pump device 58 within reservoir assembly 32.

As can be seen, reservoir assembly 32 includes a pump mounting element 74 fixedly connected to the container housing 34, Typically the pump mounting element will be part of the top portion 38 of the container housing. In the illustrated embodiment, for example, mounting element 74 is configured as a disc-shaped member having a threaded portion 76. The outer threads of threaded portion 76 are engaged by the inner threads of cap element 70, as shown. The periphery of mounting element 74 is affixed by welding, adhesive or other suitable means to walls 78 of the pump mounting element 74. The walls 78 extends, as shown, to the bottom surface of top portion 38 of the reservoir. Other suitable means may be used to hold the pump assembly 58 in the container housing 34.

An engaging element 64 is fixed to the pump's piston 66. In the illustrated embodiment, engaging element 64 is configured having a cylindrical portion 79, and a disc-shaped flange which forms contact portion 80. The engaging element 64 is located near the central axis of the reservoir assembly. Reciprocative movement of engaging element 64 will cause piston 66 to move within the cylinder. Piston 66 is normally urged into an upward position due to the force of a helical spring 82.

Pump device 58 is further provided with a pair of check valves 84 and 86 to ensure proper flow of the viscous liquid. Check valve 84, located at the base of pump cylinder 68, allows viscous liquid to be drawn into a lower pump chamber 88 when piston 64 moves in a upward direction. When piston 64 moves in a downward direction, check valve 86 allows the viscous liquid to be passed into an upper pump chamber 90. As a result, the viscous liquid will be pumped into and through flexible tube 44. While a variety of different check valve configurations are contemplated, the illustrated embodiment utilizes common ball and seat valves. In typical fashion, a suitable cage 92 may be provided in lower chamber 88 as shown.

As shown, eductor 94 reciprocatively moves in a tubular receiving portion 96 of fluid outlet 46. A seal element 98, here in the form of a suitable O-ring seal, is provided extending between the outer surface of eductor 94 and the inner surface of receiving portion 96. The viscous liquid is thus more fully directed only into flexible tube 44.

Generally, the pump device 58 will be housed in the top portion 38 of the container housing 34 of the reservoir assembly 32. Alternatively, the pump device may be housed within the main container 36. However, from an ease of manufacture standpoint, the pump device is generally located in the top portion 38 of the reservoir assembly 32.

Figure 8:
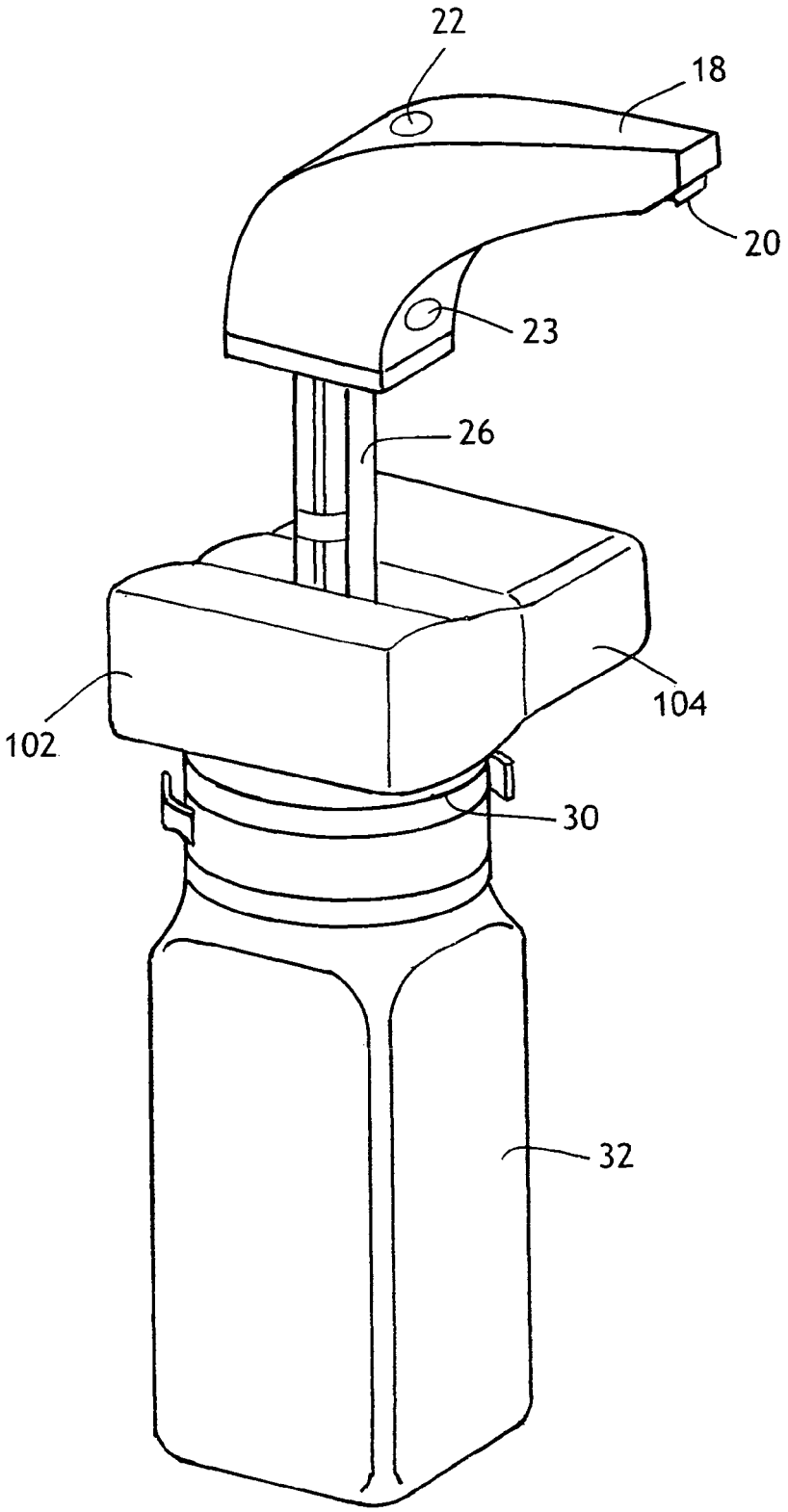
FIG. 8 illustrates a perspective view of an electronic viscous liquid dispenser embodiment of the present invention.

As shown above in FIG. 3, the pump is manually operated, meaning the user applies a force to the actuation button 22 which cause the pump to dispense a quantity of the viscous liquid from a reservoir to the delivery spout 20. In an alternative embodiment of the present invention, the pump is electronically activated. An example of an electronic viscous liquid dispensing system is shown in FIG. 8. An electronically activated pump may operate in many different ways. One way is to have a user push an actuation button 22 located on or near the dispensing head or to provide a sensor 23 which would detect the users hands under the spout 20.

As can be seen in FIG. 8, the electronic viscous liquid dispensing system has a dispensing head 18, and elongated tube 26, a motor housing 102, a power pack housing 104, a connecting member 30 and a reservoir assembly 32. Essentially the components are similar or are the same as described above with the exception that the motor housing 102 is positioned between the elongated tube 26 and the connecting member 30. In addition the power pack housing 104 contains a power supply which is electrically connected to the motor. The dispensing head 18 has an actuator button 22, and/or a sensor 23 which is used to activate a motor which engages the pump. The actuator button 22 and/or the sensor 23 are electrically connected to the motor. Generally, the actuator button 22 and/or the sensor 23 are electrically connected to a control panel (not shown) having control circuitry which is used to detect a user's hand near under the spout 20, or the user's input to the actuator button 22. In addition, the control circuitry is used to activate the motor for a given period of time so that the user receives a dose of the viscous liquid. Control circuitry for sensors and buttons is known to those skilled in the art and is shown, for example in U.S. Pat. No. 6,929,150 to Muderlak et al., which is hereby incorporated by reference.

In the electronic viscous liquid dispensing system, the connecting element 30 is connected to the motor housing 102 and power supply housing 104. Alternatively, the motor housing 102 is integral with the connecting member 30, meaning that the motor housing 102 and connecting member 30 are a single unit. Typically, the power supply 104 may be separated from the motor housing so that the power supply may be replaced when needed. That is, the power supply is disconnectable and reconnectable to the motor housing. To ensure that power is transferable from the power supply 104 to the motor housing, electrical contact points may be used on both the motor housing and power supply, such that the electrical contact points are in complementary positions, meaning that when power supply is attached to the motor housing an electrical connection is made.

Figure 9A:
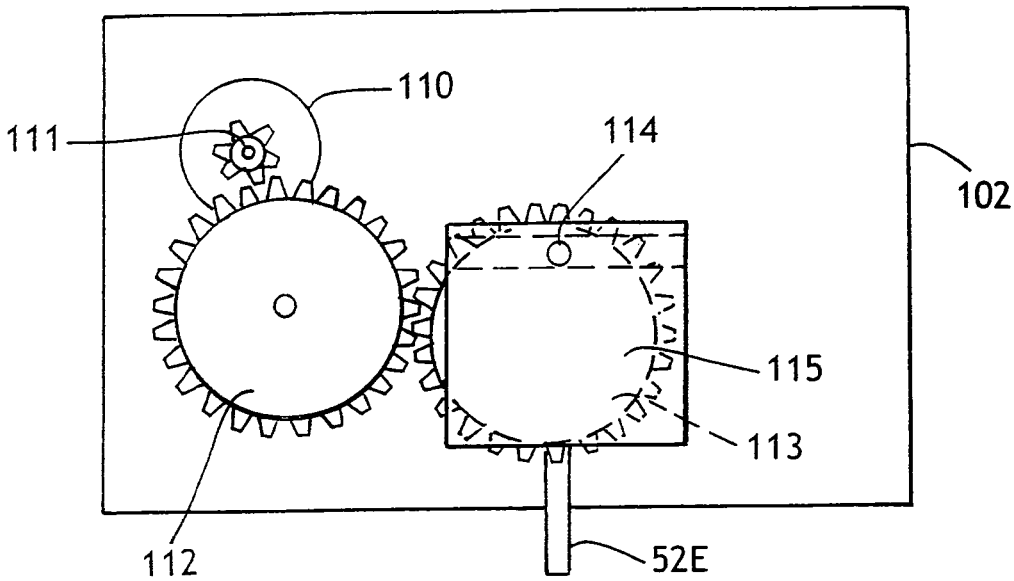
FIG. 9A shows a front view of a motor power transmission system usable in the present invention.

To gain a better understanding of a possible configuration of the motor housing 102, attention is now directed to FIGS. 9A, B, C and D. The motor housing 102 houses a motor 110, gears 111, 112 which are engaged with motor 110 and an additional gear 113 which drives an actuator rod 52E. The motor driven actuator rod 52E is housed in the motor housing 102 and extends from the motor housing 102 through an opening present in the lower surface 31 of the connecting member 30. Any method may be used to drive the motor driven actuator rod 52E. In a typical operation of the electronic viscous liquid dispensing system, the motor driven actuator rod 52E contacts the engaging element 64 and pushed the engaging element 58 downward to activate the pump 58 one or more times to expel a dose of the viscous liquid from the spout 20 of the dispensing head 18, in a similar manner shown in FIG. 3.

Numerous ways may be used to transfer power from an activated motor to the motor driven actuator rod 52E. For example, the motor may drive a series of wheels, gears or other energy transmission means to the actuator rod 52E which extends and contacts the engaging element 64. In one embodiment of the present invention, which is intended to be an exemplary means that may be used to drive the actuator rod 52E, the drive wheel 113 has a post or shaft 114 extending from one area of the gear body near the periphery 115, as is shown if FIGS. 9A and 9B. As the motor 110 turns the motor drive wheel 111, the motor drive wheel 111 in turn rotates one of more wheels 112. In FIG. 9A, a single wheel 112 is shown; however, it may be desirable to have more wheels to reduce the rotational speed of the actuator drive wheel 113, so the pump is activated in a controlled manner. It is within the skill of those skilled in the art to select the ratio of drive wheel so that the appropriate speed is achieved of the actuator drive wheel 113. It is noted the term "wheel", as used herein is intended to cover any wheel like mechanism, including wheels per se and other wheel-like mechanisms such as gears. Generally, gears are desirable, since gears are less likely to slip during use.

Figure 9B:
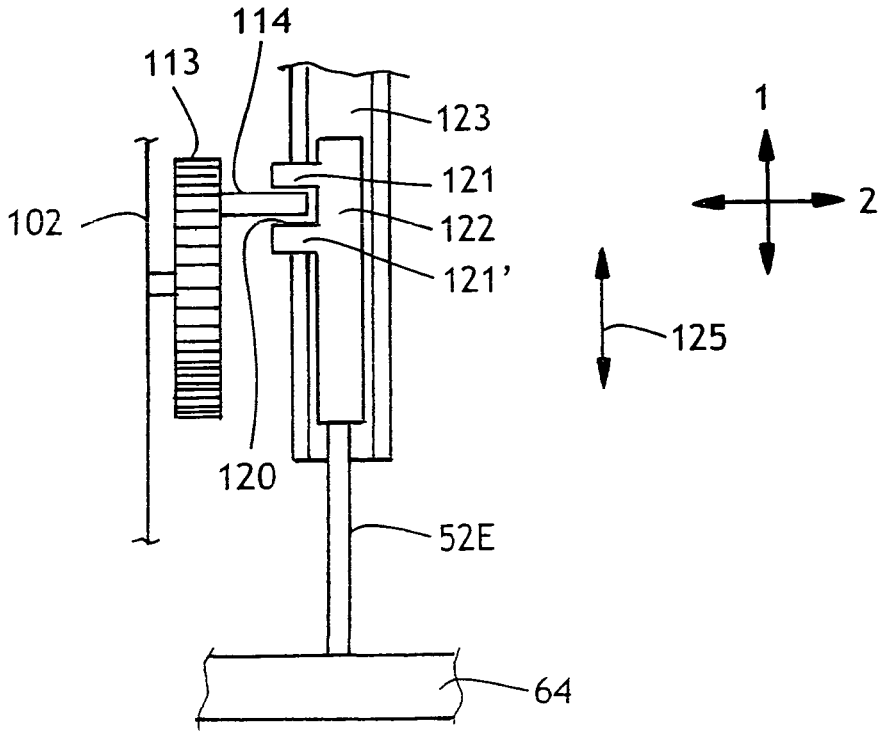
FIG. 9B shows a side view of an actuator drive wheel and an actuator guide member of an embodiment of the present invention.
Figure 9C:
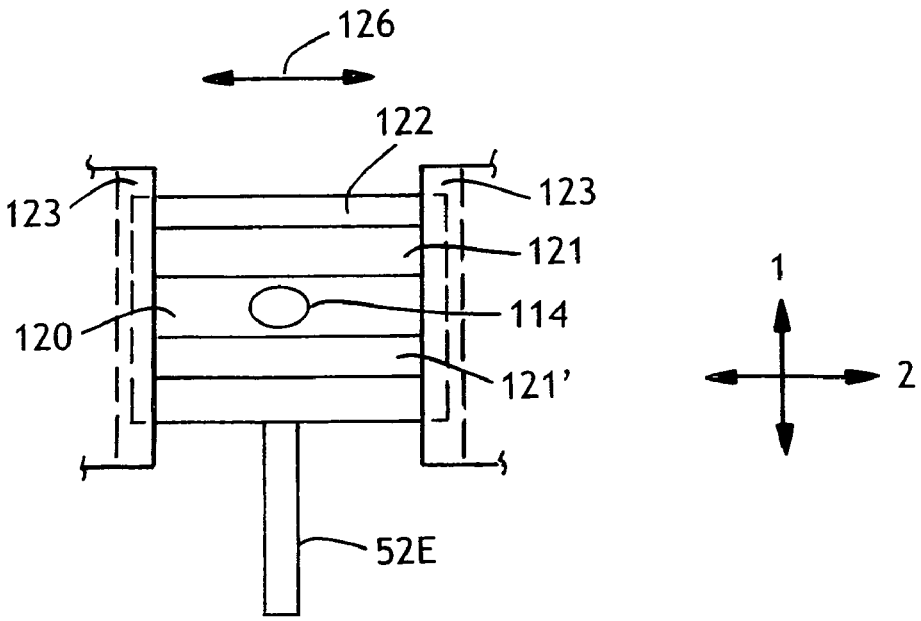
FIG. 9C shows a back side view of an actuator guide member of an embodiment of the present invention.
Figure 9D:
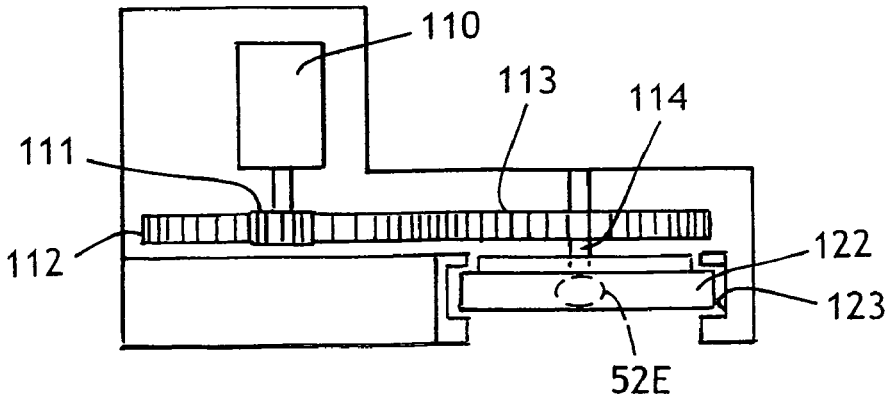
FIG. 9D shows a top view of a motor power transmission system embodiment usable in the present invention.

As is shown in FIG. 9B, the actuator drive wheel 113 has a shaft 114 extending from a non-central area of the actuator drive wheel 113, which makes the shaft rise and lower in the direction 125 as the actuator drive wheel 113 turns. This shaft 114 is fitted into a horizontal channel 122 present in the actuator guide member 120. The horizontal channel 122 is generally in the horizontal axis 2. The horizontal channel 122 is created by two horizontal protrusions 121 and 121' extending from one of the sides of the actuator guide member 120. As the actuator drive wheel turns, the shaft 114 travels in a circular path and has a vertical movement 125 in the vertical axis 1, shown in FIG. 9B and a horizontal movement 126 in the horizontal axis 2, shown in FIG. 9C. The vertical movement 125 of the shaft 114 causes the actuator guide member 120 to move up and down in the vertical axis 1, which in turn moves causes the motor driven actuator rod 52E to also move in an up and down manner in the vertical axis. Below the channel 122 present on the actuator guide member 120 is the actuator rod 52E. The actuator guide member 120 is held in place so that the movement of the actuator guide member is in an up and down manner in the vertical axis and not side to side or front to back. The actuator guide member 120 may be held in place, for example by providing vertical guide slots 123 so that the lateral sides of the actuator guide member 120 are held in place on the horizontal axis. These vertical guide slots 123 maybe provided in the motor housing 102 as is shown in FIGS. 9B, 9C and 9D.

As is mentioned above, the shaft 114 also has a horizontal movement 126 in the horizontal axis 2. This horizontal movement is essentially unwanted. To account for the horizontal movement, the shaft is allowed to move horizontally in the horizontal axis 2 along the channel 122 in the actuator guide member. Therefore, the channel 122 controls the essentially unwanted horizontal movement 126 of the shaft 114.

The electrical powered viscous liquid dispensing systems may also have additional features. For example, dispensing head 18 may have indicator lights to signal various events, such as, recognition of a user, low battery, empty soap reservoir, or other conditions such as a motor failure. Examples of such lights include low power consumption lights, such as LED (light emitting diodes).

The power source for the electronic viscous liquid dispensing system of the present invention may include disposable DC batteries (not shown). Alternatively, the power supply may be a closed system which requires that the entire power supply be replaced as a single unit. Although not shown in the figures, an AC to DC adapter may be utilized to provide an alternate source of power to the viscous liquid dispenser. This embodiment may be particularly useful wherein the viscous liquid dispenser is mounted in close proximity to an AC outlet or when it is desirable to power multiple dispensers from a centrally located transformer of suitable configuration and power. The number of batteries used to power the motor will depend on the motor selected for the dispenser. Disposable batteries useable in the present invention include 9 volt batteries, 1.5 volt batteries, such as D-cell or C-cell batteries, or other similar batteries. The exact type of battery selected for use is not critical to the present invention so long as the power supplied to the motor is compatible for the motor. For applications where the viscous liquid dispenser will be used under low usage situations, rechargeable batteries could be used. If the dispenser is to be used in a bright light situation, the batteries could be solar rechargeable batteries.

In another embodiment of the present invention, provided is a mounting system for mounting a viscous liquid dispenser. To gain an understanding of this embodiment of the present invention, attention is directed to FIGS. 10 and 11. The mounting system 200 has an elongated structure 226 having a proximate end 204, a distal end 206, and a hollow shaft 208 extending from the proximate end 204 to the distal end 206. Located at or adjacent the proximate end 204 is a flange 201. The flange 201 serves to keep the elongated tube 226 from passing through a hole (not shown) in a counter 11. An anchoring mechanism 212 is located along the sides of the elongated tube 226 intermediate the flange 201 and the distal end 206. The anchoring mechanism 212 is also located along side the hollow shaft 208. The anchoring mechanism 212 is connected to an anchoring mechanism engagement member 214 located at or near the proximate end 204 and the anchoring mechanism engagement member 214 is engagable connected to the anchoring mechanism 212. A first end 216 of the anchoring mechanism engagement member 214 has a means to rotatably turn the anchoring mechanism engagement member 214 to deploy the anchoring mechanism 212. Examples a means to rotatably turn the anchoring mechanism engagement member include head designs adapted to receive a convention screw driver, such as a slot head, a Philips head, a torex head, a hex head and the like.

The anchoring mechanism 212 is adapted to directly or indirectly contact a lower surface of the counter 11 and the flange 201 is adapted to directly or indirectly rest on an upper surface of the counter when installed. The second end 217 of the anchoring mechanism engagement member 214 may be held in place at or near the distal end of the elongated structure 226. The anchoring mechanism engagement member 214 is adapted to deploy the anchoring mechanism 212 by causing the anchoring mechanism 212 to come into contact with the bottom side of the counter 11. The anchoring mechanism 212 is caused to be moved in an upward direction 235 as the anchoring mechanism engagement member 214 is rotated.

The mounting system may have an optional gasket 202 which is positioned between the counter 11 and the flange 201. The gasket 202 serves to create a seal between the counter 11 and the flange 201 so that water and dirt do not migrate between the counter 11 and the flange 201 and fall through the hole in the counter 11 in which the elongated tube 226 is inserted. The gasket 202 also serves to protect the counter 11 from any damage that may be caused by the flange 201. Below the counter 11, an optional spacer 218 may be installed over the elongated tube 226. The spacer 218 is designed to fit against the lower surface of the counter to provide a clean contact surface for the anchoring mechanism 212 to engage. This spacer is optional and is only needed if the under side of the counter 11 is damaged when the hole is drilled into the counter 11. However, the spacer 218 may provide a better attachment of the mounting system 200 to the counter 11.

Figure 10:
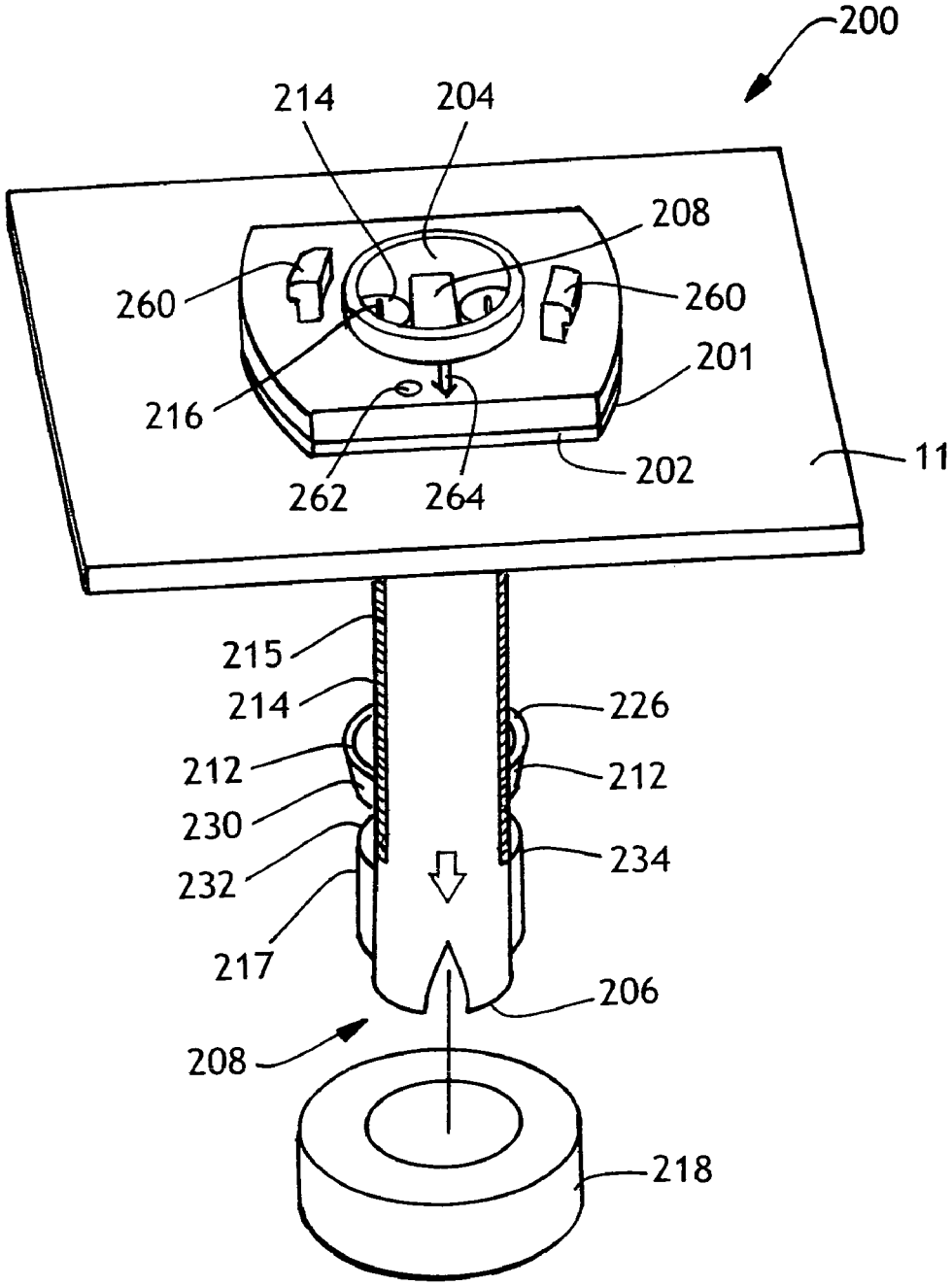
FIG. 10 shows a top-side perspective view of a mounting system of an embodiment of the present invention.
Figure 11:
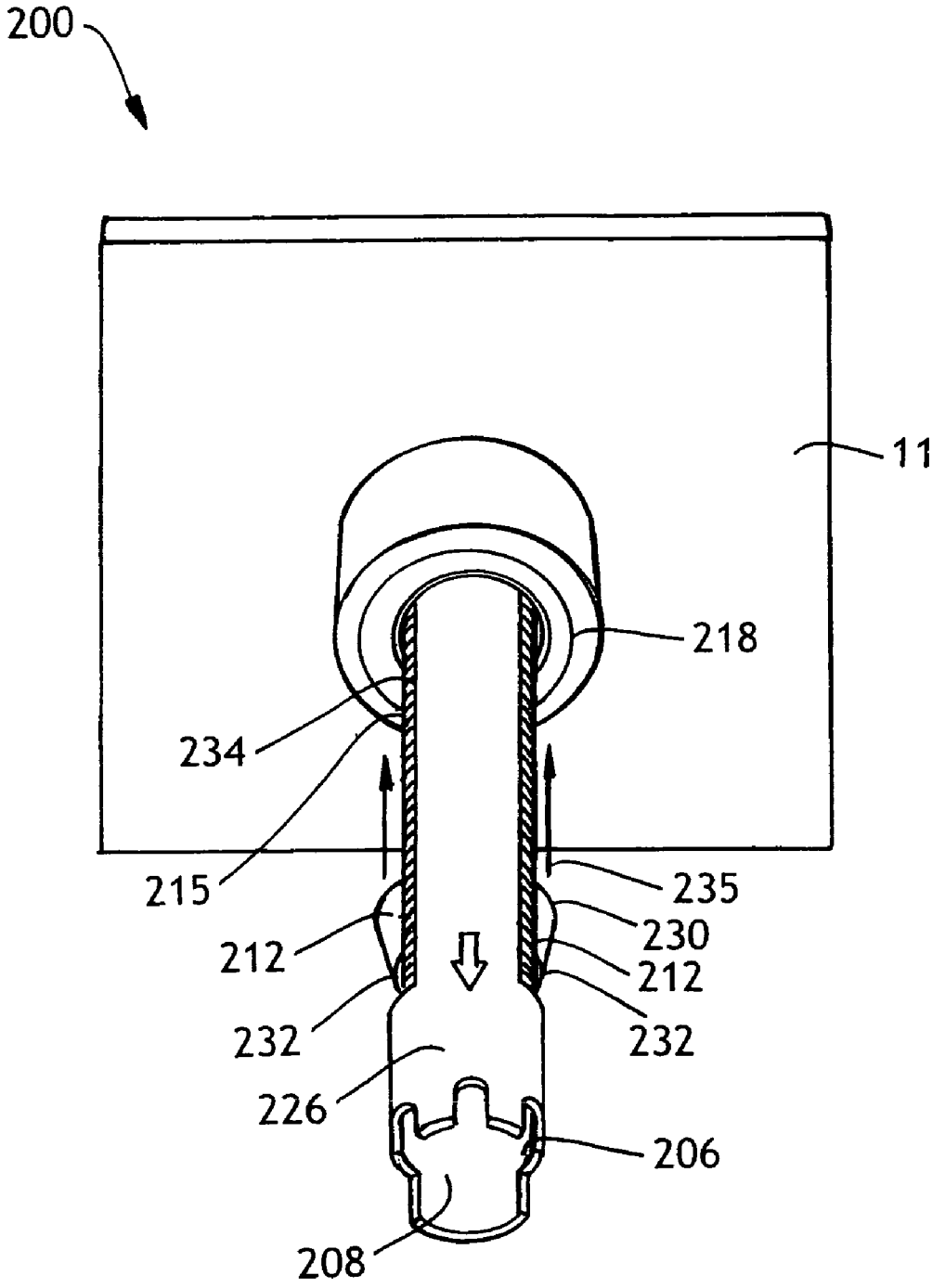
FIG. 11 shows a lower side perspective view of a mounting system of an embodiment of the present invention.

In one embodiment of the present invention, the anchoring mechanism engagement member 214 may be a threaded member extending from near the proximate end 204 of the elongated structure 226 down along the side of the elongated structure 226 and down along the side of the hollow shaft 208. The anchoring mechanism 212 may be a movable wing portion having an upper portion 230 and a lower portion 232. The upper portion 230 extends outward from the elongated structure 226 and the lower portion 232 is located adjacent the elongated structure 226. To guide the anchoring mechanism 212, the anchoring mechanism 212 may be located in a channel 234 located on the side of the elongated structure 226 below the flange 201 and above the distal end 206. As shown in FIGS. 10 and 11, there are two channels 234 present along each side of the elongated structure 226. The channels 234 serve to guide anchoring mechanism 212 by having the lower portion 232 of the anchoring mechanism positioned in the channels. Anchoring mechanism 212 is directly threaded onto the threaded member 215 or may be indirectly associated to the threaded member 215. By "directly threaded", it is intend that a portion of the anchoring mechanism 212 is threaded onto the threaded member 215. By "indirectly associated with the threaded member", it is intended that a member, such as a nut, is threaded on the threaded member 215 in such a way that the anchoring mechanism 212 moves up and down the threaded member as the threaded member 215 is turned. The nut serves to hold the anchoring mechanism 212 in place on the threaded member 215, but in such a way that the anchoring mechanism 212 does not move up or down the threaded member 215 without movement of the nut.

Figure 11A:
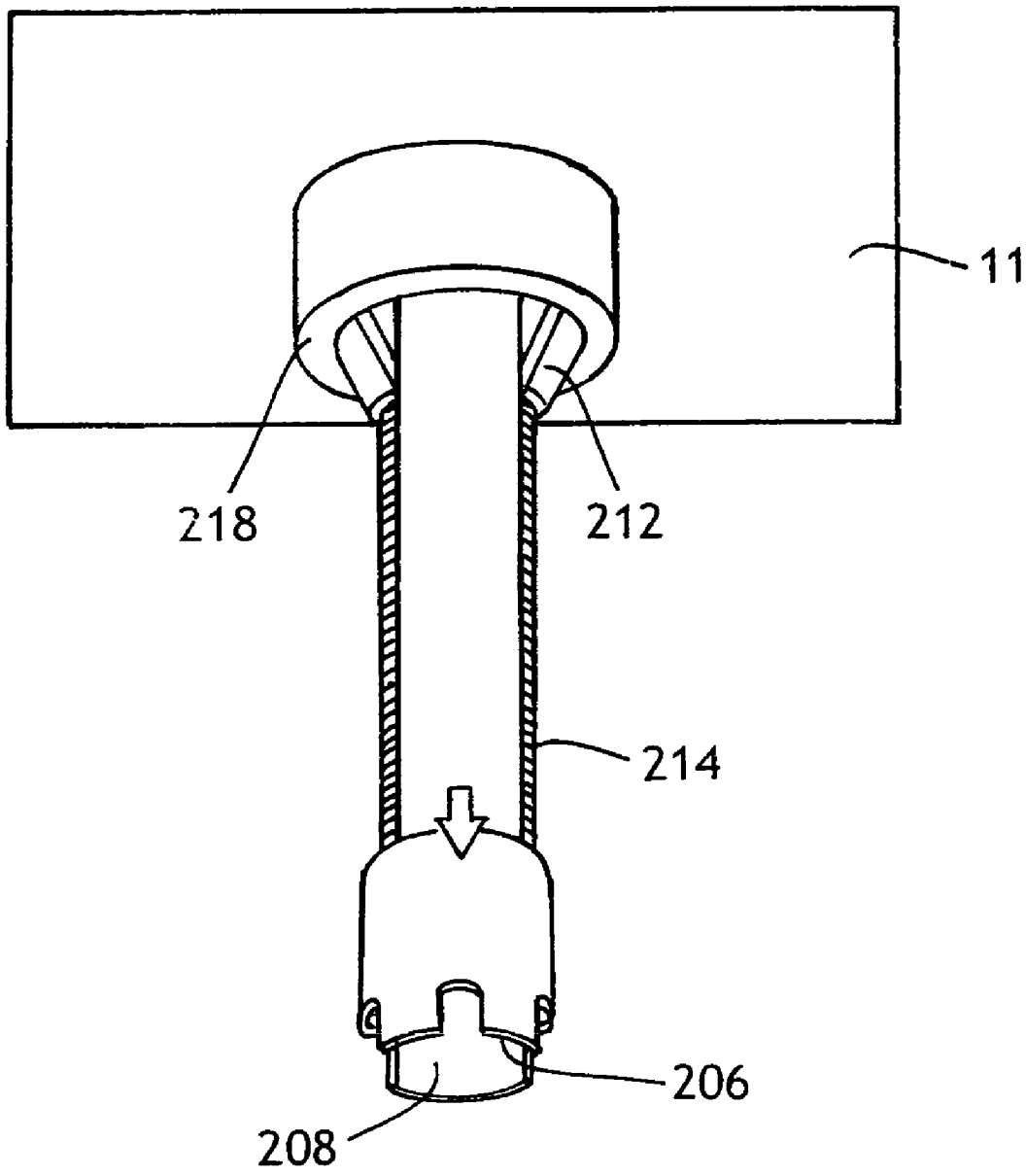
FIG. 11A shows a lower side perspective view of a mounting system of an embodiment of the present invention, with the anchoring mechanism contacting the space in a tightened condition.

To attach the mounting system shown in FIGS. 10 and 11, the elongated structure 226, with the flange 201 is inserted in a hole in the counter 11. Generally, the anchoring mechanism 212 is positioned near the distal end 206 of the elongated structure 226 and within the channels 234. Optionally, the gasket 202 is placed on the counter 11 around the hole which is placed in the counter 11 or may be slipped onto the elongated member 226 before the distal end of the elongated structure 226 is inserted in the hole in the counter 11. The optional spacer 218 may be inserted over the elongated structure 226, if the spacer is needed or desire. Next, the top 216 of the anchoring mechanism engagement member 214 is rotated to cause the anchoring mechanism 212 to move in an upward direction 235, as is shown in FIG. 11. The anchoring mechanism 212 is moved all the way up to the bottom of the counter 11 or up to the spacer 218, if present, until the anchoring mechanism engagement member can not be turned any more, as is shown in FIG. 11A. The flange 201 and anchoring mechanism 212 sandwich the counter 11 between the them, holding the mounting system station are and in place.

Figure 12:
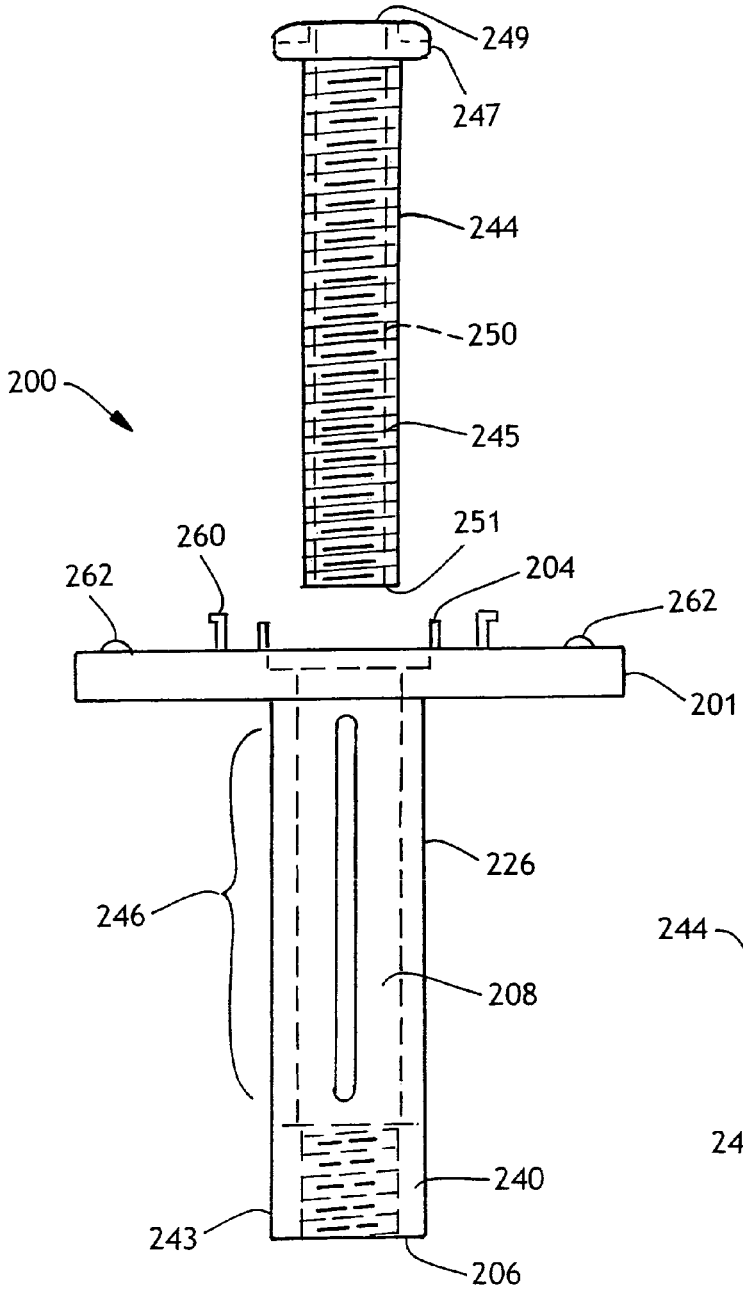
FIG. 12 shows a second embodiment of a mounting system usable in the present invention.

Another embodiment of a mounting system useable in the present invention is shown in FIG. 12. In this embodiment of the present invention, the mounting system 200 has an elongated structure 226 having a proximate end 204, a distal end 206, and a hollow shaft 208 extending from the proximate end 204 to the distal end 206. Located at or adjacent the proximate end 204 is a flange 201. The flange 201 serves to keep the elongated tube 226 from passing through a hole (not shown) in a counter (also not shown in FIG. 12). The hollow shaft 208 comprises a collar 240 located at or adjacent the distal end 206. The collar 240 has an inner surface 242 adapted to receive and engage a hollow threaded member 244 having threads 245. One way the inner surface 242 is adapted to receive and engage the hollow threaded member 244 is the inner surface also has complementary threads 243. The elongated structure 226 also has a collapsible sleeve portion 246 located intermediate the collar 240 and the flange 201. The collapsible sleeve portion 246 may be prepared by many known method, such providing an elongated tube 226 have an area which is weaker than other areas of the elongated tube 226; by placing one or more lines of weakness along the sides of the elongated tube; or by providing slits along the sides of the elongated tube 226. The hollow threaded member 244 has a passage 250 which extends from the opening 249 located near the top 247 of the threaded member 244 to the bottom end 251 of the threaded member 244.

Figure 12A:
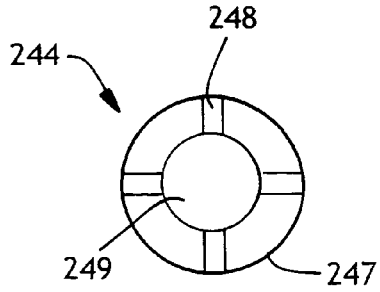
FIG. 12A shows a top view of the threaded member of the mounting system of FIG. 12.

To anchor the mounting system 200 to the counter, the hollow threaded member 244 is inserted the proximate end 204 of the elongated structure 226, as is shown in FIG. 12. The threads 245 of the hollow threaded member 244 engage the threads 243 of the inner surface 242 of the collar 240. The top surface 247 of the threaded member 244 may have grooves which are adapted to receive a torque device, such as a screwdriver as is shown in FIG. 12A. For example slots 248 could be adapted to accept a screw driver such as a Phillips head, a slot head screwdriver device. Alternatively, the opening 249 could be shaped to accept a hex head driver or other similar drivers. Once the threads 245 of the hollow threaded member 244 engage the threads 243 of the inner surface 242 of the collar 240, the hollow threaded member 244 is torqued.

Figure 12B:
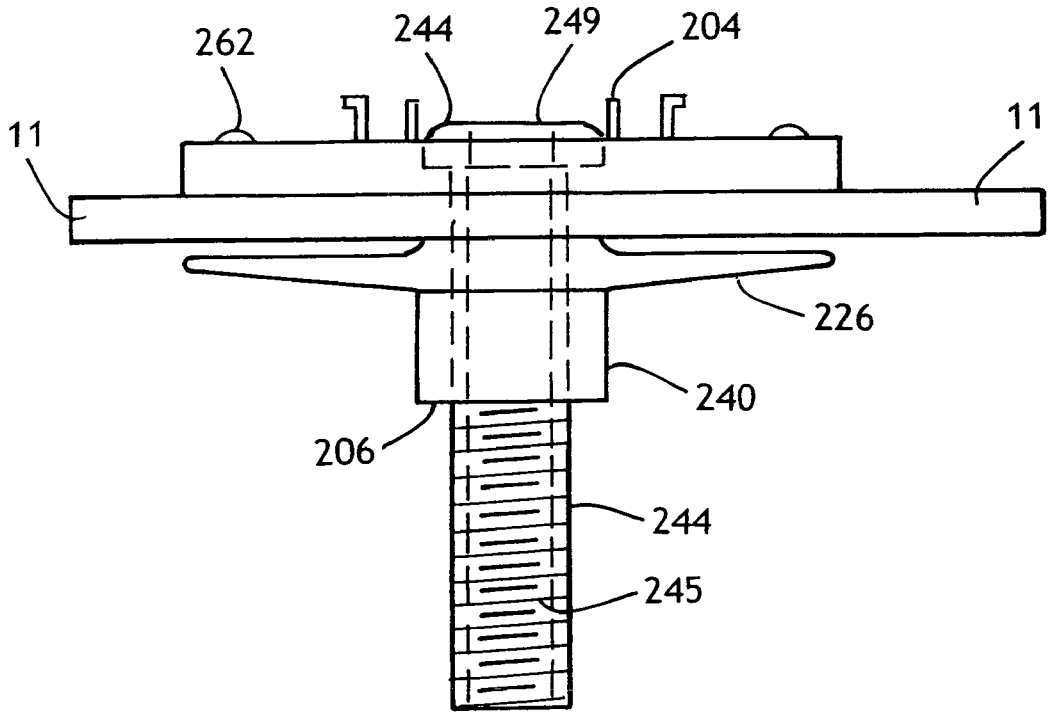
FIG. 12B show a side view of the mounting system of FIG. 12 in a tightened state.

As the hollow threaded member 244 is torqued or rotated in a given direction, the collar 240 is moved towards the flange 201. This causes the collapsible section 246 to begin to collapse until the collar 240 is nearly in contact with the bottom surface of the counter, as is shown in FIG. 12B, thereby securing the mounting system to the counter 11. In each of the mounting systems described herein, the mounting system can be installed solely from the top of the counter 11.

Since the mounting systems described above do not have the dispensing head as part of the elongated tub 226, the flange 201 of the mounting system or the proximate end 206 of the elongated tube 226 further has a locking members 260, 262 which are designed to hold and secure a dispensing head (not shown) in place on the mounting system during use. In one embodiment of the present invention, the dispensing head has complementary locking members which are adapted to engage the locking members on the flange 201. Examples of locking members include locking members with detent elements 260 and protrusions 262 on the flange member 201. The flange member 201 may also include indicia to indicate to the installer which way the mounting member is to be installed.

The distal end 206 of each embodiment of the elongated tube 226 of each mounting system has a connecting means which allows the distal end of the elongated tube 226 to connect to other members of the dispensing system, such as the motor housing, the connecting member or other parts. For example, the distal end 206 of the elongated tube 226 may have grooves, recesses, detents or other similar features which will allow the parts of the dispensing system to be connected to one another, preferable removably connected.

Figure 13:
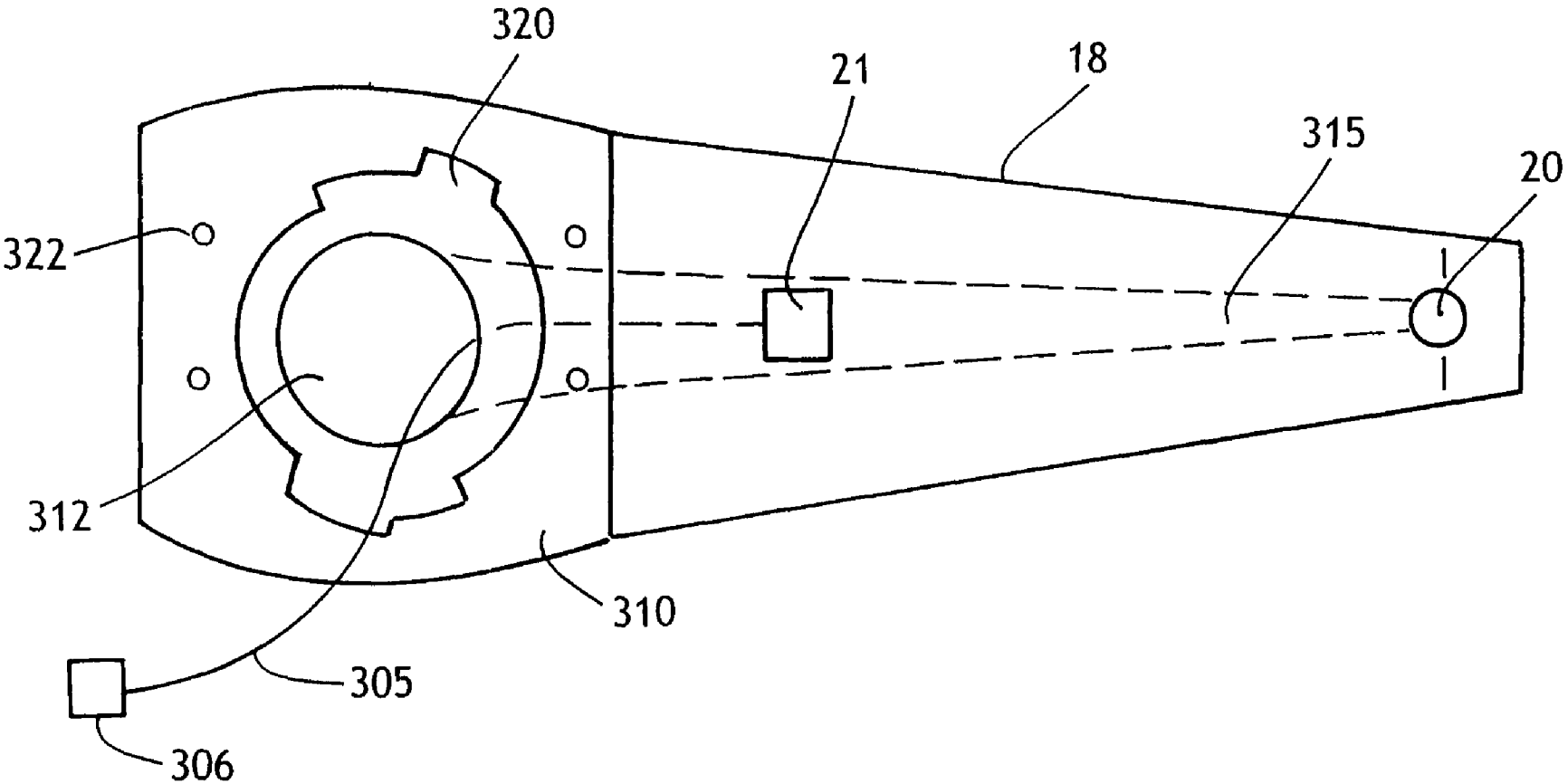
FIG. 13 shows a bottom plan view of an embodiment of a dispensing head of the present invention.

The dispensing head 18, for example as is shown in FIG. 1, could be made to be removable from the flange. FIG. 13 shows a bottom view of the dispensing head 18. As shown, the dispensing head 18 may have an electronic sensor 21 positioned between the bottom plate 310 and the delivery spout 20. This sensor 21 is designed to detect a user's hand below the spout 20. When detected, the sensor sends a single to a motor to activate a pump to dispense a dose of the viscous liquid to the hands of the user. Power for the sensor and the signal to the pump are carried over an electrical wire 305 having a connector 306 on the end thereof. The electrical wire 305 is placed down the hollow shaft 208 of the elongated tub 226 and is connected into an electrical connector on the motor housing. The wire 305 is long enough to reach the motor housing.

As is also shown in FIG. 13, the bottom plate has on opening 312 which extends is generally positioned over the hollow shaft 208 of the elongated tube 226. The opening 312 is connected to the delivery spout 20 by a channel 315, thereby allowing the flexible delivery tube 44 placed in to the elongated tube 226 to reach the end of the delivery spout 20, in a similar manner as shown in FIG. 3.

The bottom plate 310 has mounting means which are complementary to the locking features 260 and 262 present on the flange 201. Examples of the complementary locking features include, for example, cut outs 320 present in the bottom plate 310, which allow the locking features 260 present on the flange 201 to secure the dispensing head 18 to the flange. In addition, the bottom plate may have recesses 322 with are complementary to the protrusions on the flange 201. The specific type of locking member or complementary locking member is not critical to the present invention, so long as the locking features will securely hold the dispensing head 18 to the elongated tube 226, but will release the dispensing head 18 if the dispensing head needs to be replaced.

In an alternative embodiment, the dispensing head 18 may have an actuator rod extending from the opening 312, if the dispensing head is a manual dispensing head, similar to the one shown in FIG. 3.

In the present invention, the mounting systems of the present invention may be used in combination with the dispensing apparatus of the present invention.

Although the present invention has been described with reference to various embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

The invention claimed is:

1. A reservoir assembly for use with an in-counter mounted viscous liquid dispenser comprising:

a container housing for holding a quantity of a viscous liquid, said container housing comprising a main container and a top portion secured to the main container, said top portion comprising a central longitudinal axis, a mounting element selected from the group consisting of a movable member having a detent element or a stationary member having a recessed portion adapted to accept a detent element, wherein the movable member is movable about a pivot point and the pivot point is on the opposite end of the movable member from detent element;

a pump device located within the container housing, the pump device operative to pump the viscous liquid through a fluid outlet defined in the top portion of the container housing; and an engaging element operative to cause actuation of the pump device, the engaging element located along the central longitudinal axis of the top portion.

2. The reservoir assembly according to claim 1, wherein the mounting element comprises a moveable member having a detent element.

3. The reservoir assembly according to claim 2, wherein there are at least two movable members present on the container housing, said two movable members being diametrically opposed on opposite sides of the container housing.

4. The reservoir assembly according to claim 3, where there are four movable members with detent elements, wherein there are two movable members on each side of the container housing and each movable member is diametrically opposed the other two movable members with detent elements.

5. The reservoir assembly according to claim 2, wherein the moveable member further comprises arm and upright member positioned along the movable member between the pivot point and the detent element.

6. The reservoir assembly according claim 1, further comprising a flexible tube extending out an outlet present in the top portion of the reservoir assembly.

7. The reservoir assembly according to claim 1, wherein the pump device is located in the top portion of the container housing.

8. The reservoir assembly according to claim 1, wherein the movable members with detent elements are present on the top portion of the container housing.

9. A counter mounted viscous liquid dispensing apparatus comprising a reservoir assembly comprising i. a container housing for holding a quantity of a viscous liquid, said container housing comprising top portion, said top portion comprising a central longitudinal axis, a mounting element selected from the group consisting of a movable member having at least one detent element on a surface of the movable member or a stationary member having a recessed portion, wherein the movable member is movable about a pivot point and the pivot point is on the opposite end of the movable member from the detent element;

ii. a pump device located within the container housing, the pump device operative to pump the viscous liquid through a fluid outlet defined in the top portion of the container housing;

iii. an engaging element operative to cause actuation of the pump device, the engaging element located along the central longitudinal axis of the top portion;

a fixture assembly mounted to a counter comprising i. a dispenser head mounted to the counter;

ii. a connecting member directly or indirectly mounted to the dispenser head, the connecting member comprises a mounting element wherein the mounting element of the connecting member is a complementary mounting element to the mounting element of the top portion and comprises a stationary member having a recessed portion when the top portion mounting element comprises a movable member having at least one protrusion or comprises a movable member having at least one detent element when the top portion mounting element comprises a stationary member having at least one recess portion.

10. The counter mounted viscous liquid dispensing apparatus according to claim 9, further comprising a mounting system, said mounting system comprising:

an elongated structure comprising a proximate end, a distal end, a hollow shaft extending from the proximate end to the distal end, a flange located at or adjacent the proximate end, an anchoring mechanism located along the shaft intermediate the flange and the distal end; and an anchoring mechanism engagement member located at or near the proximate end;

wherein the anchoring mechanism is adapted to directly or indirectly contact a lower surface of the counter and the flange is adapted to directly or indirectly rest on a upper surface of the counter and the anchoring mechanism engagement member is adapted to deploy the anchoring mechanism to secure the elongated structure to the counter.

11. The counter mounted viscous liquid dispensing apparatus according to claim 10, wherein the anchoring mechanism engagement member comprises a threaded member extending from near the proximate end of the elongated structure down along the side of the shaft and the anchoring mechanism comprises a movable wing having a upper portion and a lower portion, the upper portion extends outward from the shaft and the lower portion is located adjacent the shaft, and the wing is threaded on the threaded member.

12. The counter mounted viscous liquid dispensing apparatus according to claim 11, wherein the shaft comprises at least one channel located on an outer surface of the shaft, the wing and the threaded member are located in the channel such that the lower portion of the wing is positioned in the channel and the upper portion of the wing extends outward from the channel.

13. The counter mounted viscous liquid dispensing apparatus according to claim 12, wherein the shaft comprises two channels, each channel comprising a wing and threaded member located therein.

14. The counter mounted viscous liquid dispensing apparatus according to claim 9, wherein the mounting element comprises a moveable member having a detent element.

15. The counter mounted viscous liquid dispensing apparatus according to claim 14, wherein there are at least two movable members present on the container housing, said two movable members being diametrically opposed on opposite sides of the container housing.

16. The counter mounted viscous liquid dispensing apparatus according to claim 15, where there are four movable members with detent elements, wherein there are two movable members on each side of the container housing and each movable member is diametrically opposed the other two movable members with detent elements.

17. The counter mounted viscous liquid dispensing apparatus according to claim 15, further comprising arm and upright member positioned along the movable member between the pivot point and the detent element.

18. The counter mounted viscous liquid dispensing apparatus according claim 9, further comprising a flexible tube extending out an outlet present in the top portion of the reservoir assembly.

19. The counter mounted viscous liquid dispensing apparatus according to claim 9, wherein the pump device is located in the top portion of the container housing.

20. The counter mounted viscous liquid dispensing apparatus according to claim 9, wherein the movable members with detent elements are present on the top portion of the container housing.

21. A mounting system for mounting a viscous liquid dispenser in a counter, said mounting system comprising:

an elongated structure comprising a proximate end, a distal end, a hollow shaft extending from the proximate end to the distal end, a flange located at or adjacent the proximate end, an anchoring mechanism located along the shaft intermediate the flange and the distal end; and an anchoring mechanism engagement member located at or near the proximate end;

wherein the anchoring mechanism is adapted to directly or indirectly contact a lower surface of the counter, the flange is adapted to directly or indirectly rest on an upper surface of the counter, and the anchoring mechanism engagement member is adapted to deploy the anchoring mechanism to secure the mounting system to the counter, and wherein the anchoring mechanism engagement member comprises a threaded member extending from near the proximate end of the elongated structure down along the side of the shaft and the anchoring mechanism comprises a movable wing having a upper portion and a lower portion, the upper portion extends outward from the shaft and the lower portion is located adjacent the shaft, and the wing is threaded on the threaded member.

22. The mounting system according to claim 21, wherein the shaft comprises at least one channel located on an outer surface of the shaft, the wing and the threaded member are located in the channel such that the lower portion of the wing is positioned in the channel and the upper portion of the wing extends outward from the channel.

23. The mounting system according to claim 22, wherein the shaft comprises two channels, each channel comprising a wing and threaded member located therein.

24. The mounting system according to claim 21, wherein the hollow shaft comprises a collar located at or adjacent the distal end, the collar having an inner surface adapted to receive and engage a threaded member; and a collapsible sleeve portion located intermediate the collar and the flange; and the anchoring mechanism engagement member comprises a threaded member which extends from the proximate end of the shaft to the collar and engages the inner surface of the collar;

wherein when the engagement member is rotated in a predetermined direction the collar is caused to move towards the flange and the collapsible sleeve portion is caused to expand outwards and contact the lower surface of the counter.

25. The mounting system according to claim 21, further comprising a dispenser head locking member located between the flange and the distal end, wherein the locking member serves to secure a dispenser head to the mounting system.

26. The mounting system according to claim 21, wherein the distal end further comprises a connecting means for connecting to the under counter portion of a dispensing system.

27. The mounting system according to claim 21, further comprising a mounting ring which is placed over the shaft from the distal end, wherein the mounting ring contacts the bottom surface of the counter and the anchoring mechanism contacts the mounting ring.

28. The mounting system according to claim 21, further comprising a gasket, the gasket is adapted be placed between the counter and the flange.

* * * * *